US012686829B2

(12) United States Patent
Reid et al.

(10) Patent No.: US 12,686,829 B2
(45) Date of Patent: Jul. 21, 2026

(54) USE AND METHOD

(71) Applicant: INNOSPEC LIMITED, Ellesmere Port (GB)

(72) Inventors: Jacqueline Reid, Ellesmere Port (GB); John Nigel Broom, Ellesmere Port (GB)

(73) Assignee: INNOSPEC LIMITED, Ellesmere Port (GB)

( * ) Notice: Subject to any disclaimer, the term of this patent is extended or adjusted under 35 U.S.C. 154(b) by 0 days.

(21) Appl. No.: 18/695,541

(22) PCT Filed: Apr. 26, 2023

(86) PCT No.: PCT/GB2023/051111

§ 371 (c)(1),
(2) Date: Mar. 26, 2024

(87) PCT Pub. No.: WO2023/209375

PCT Pub. Date: Nov. 2, 2023

(65) Prior Publication Data

US 2025/0043204 A1 Feb. 6, 2025

(30) Foreign Application Priority Data

Apr. 26, 2022 (GB) ..... 2206073

(51) Int. Cl.

| | |
|---|---|
| ***C10L 1/232*** | (2006.01) |
| ***C10L 1/222*** | (2006.01) |
| ***C10L 10/04*** | (2006.01) |

(52) U.S. Cl.

CPC ..... *C10L 1/232* (2013.01); *C10L 1/222* (2013.01); *C10L 1/2222* (2013.01); (Continued)

(58) Field of Classification Search

CPC ..... C10L 1/222; C10L 1/2222; C10L 1/224; C10L 1/2286; C10L 1/232; C10L 10/04; (Continued)

(56) References Cited

U.S. PATENT DOCUMENTS

| | | | |
|---|---|---|---|
| 5,925,151 | A | 7/1999 | DeCanio et al. |
| 7,291,758 | B2 | 11/2007 | Bohnenpoll et al. |

(Continued)

FOREIGN PATENT DOCUMENTS

| | | | |
|---|---|---|---|
| CN | 114317045 | A | 4/2022 |
| EP | 0152663 | A1 | 8/1985 |

(Continued)

OTHER PUBLICATIONS

International Search Report (ISR) for PCT/GB2023/051111 mailed Jun. 7, 2023 (4 pages).

(Continued)

*Primary Examiner* — Ellen M McAvoy
*Assistant Examiner* — Chantel Graham
(74) *Attorney, Agent, or Firm* — Jason A. Smith; Shumaker, Loop & Kendrick, LLP

(57) ABSTRACT

The use of a nitrogen containing detergent as an additive in a diesel fuel composition to reduce the impact of deposits in a post combustion system of a diesel engine when combusting said diesel fuel composition.

22 Claims, 1 Drawing Sheet

(52) U.S. Cl.
CPC ..... *C10L 1/2225* (2013.01); *C10L 10/04* (2013.01); *C10L 2200/0446* (2013.01); *C10L 2230/22* (2013.01); *C10L 2270/026* (2013.01)

(58) Field of Classification Search
CPC ..... C10L 10/06; C10L 2270/026; C10L 1/22; C10L 1/221; C10L 10/18
See application file for complete search history.

(56) References Cited

U.S. PATENT DOCUMENTS

| | | | | |
|---|---|---|---|---|
| 10,308,888 | B1 | 6/2019 | Schwab | |
| 2008/0052985 | A1 | 3/2008 | Stevenson et al. | |
| 2008/0113890 | A1 | 5/2008 | Moreton et al. | |
| 2008/0307698 | A1 | 12/2008 | Barton et al. | |
| 2010/0299992 | A1 | 12/2010 | Reid | |
| 2011/0258917 | A1 | 10/2011 | Garcia Castro et al. | |
| 2011/0315107 | A1 | 12/2011 | Grabarse et al. | |
| 2012/0010112 | A1 | 1/2012 | Grabarse et al. | |
| 2013/0031827 | A1 | 2/2013 | Reid et al. | |
| 2013/0031828 | A1 | 2/2013 | Reid et al. | |
| 2013/0104826 | A1* | 5/2013 | Burgess | C10L 1/18 44/422 |
| 2014/0157656 | A1 | 6/2014 | Reid | |
| 2014/0157657 | A1 | 6/2014 | Reid | |
| 2014/0173972 | A1 | 6/2014 | Brewer et al. | |
| 2014/0173973 | A1* | 6/2014 | Brewer | C10L 1/1857 44/388 |
| 2014/0174390 | A1 | 6/2014 | Reid et al. | |
| 2014/0174391 | A1 | 6/2014 | Reid | |
| 2017/0218291 | A1 | 8/2017 | Reid et al. | |
| 2019/0345406 | A1* | 11/2019 | Moreton | C10L 1/2383 |
| 2020/0024536 | A1 | 1/2020 | Shanahan et al. | |
| 2021/0017464 | A1 | 1/2021 | Galante-Fox et al. | |
| 2021/0024844 | A1 | 1/2021 | Taylor et al. | |
| 2022/0325195 | A1 | 10/2022 | Galante-Fox et al. | |
| 2023/0077913 | A1 | 3/2023 | Schwab et al. | |

FOREIGN PATENT DOCUMENTS

| | | | | |
|---|---|---|---|---|
| EP | 0385633 | A1 * | 9/1990 | C10L 1/221 |
| EP | 0565285 | A1 | 10/1993 | |
| EP | 0831141 | A1 | 3/1998 | |
| EP | 1254889 | A1 | 11/2002 | |
| EP | 2302020 | A1 | 3/2011 | |
| EP | 2631283 | A1 | 8/2013 | |
| GB | 960493 | A | 6/1964 | |
| GB | 2625160 | A | 3/2025 | |
| WO | 2006/135881 | A2 | 12/2006 | |
| WO | 2007/015080 | A1 | 2/2007 | |
| WO | 2009/040582 | A1 | 4/2009 | |
| WO | 2009/040583 | A1 | 4/2009 | |
| WO | 2009040585 | A1 | 4/2009 | |
| WO | 2010097624 | A1 | 9/2010 | |
| WO | 2011/095819 | A1 | 8/2011 | |
| WO | 2011110860 | A1 | 9/2011 | |
| WO | 2013/017887 | A1 | 2/2013 | |
| WO | 2013/017889 | A1 | 2/2013 | |
| WO | 2014066344 | A1 | 5/2014 | |
| WO | 2015/011506 | A1 | 1/2015 | |
| WO | 2015/011507 | A1 | 1/2015 | |
| WO | 2015011505 | A1 | 1/2015 | |
| WO | WO-2015183908 | A1 * | 12/2015 | C10L 1/1883 |
| WO | WO-2016016641 | A1 * | 2/2016 | C07C 211/62 |
| WO | 2017/017454 | A1 | 2/2017 | |
| WO | 2020/120416 | A1 | 6/2020 | |
| WO | 2022084281 | A1 | 4/2022 | |
| WO | WO-2023047134 | A1 * | 3/2023 | C10L 1/1811 |

OTHER PUBLICATIONS

Written Opinion (WO) for PCT/GB2023/051111 mailed Jun. 7, 2023 (6 pages).
Great Britain Search Report (GBSR) for GB 2206073.5 mail Oct. 27, 2022 (3 pages).
Anonymous: "Worldwide Fuel Charter", sixth edition, Gasoline and Diesel Fuel, Oct. 18, 2019, pp. 1-105.
Lance, M. J.; Storey, J.; Lewis, S.; and Sluder, S. Analysis of Lacquer Deposits and Plugging Found in Field-Tested EGR Cooler. SAE Technical Paper (2014), 7 pages.
Lance, M. J.; Mills, Z. G.; Seylar, J. C.; Storey, J. M.; and Sluder, C. S. The Effect of Engine Operating Conditions on Exhaust Gas Recirculation Cooler Fouling. International Journal of Heat and Mass Transfer (2018), 126, 509-520.
Examination Report (ER) for corresponding Patent Application No. GB2306160.9; Dec. 20, 2024; 4 pages.
Examination Report (ER) for corresponding Patent Application No. GB2306163.3; Dec. 20, 2024; 5 pages.
Non-Final Office Action (NFOA) from U.S. Appl. No. 18/638,046; mailed on Jun. 12, 2025; 15 pages.
Non-Final Office Action (NFOA) from U.S. Appl. No. 18/859,461; mailed on Jun. 27, 2025; 8 pages.
Dabelstein, W.; Reglitzky, A.; Schutze, A.; Reders, K.; and Brunner, A.; Automotive Fuels. Ullmann's Encyclopedia of Industrial Chemistry, 2016, 1-41.
Williams, R., et al.; Developement of an Engine Test to Rate the EGR Deposit Formation Propensity of Fuels in Light-Duty Diesel Engines. SAE Int. J. Advances & Curr. Prac. in Mobility, 3(1): 337-348, 2021.
Examination Report (ER1) from European Application No. 23722023.1; dated Jul. 22, 2025; 7 pages.
Examination Report (ER2) from European Application No. 23722023.1; dated Jul. 23, 2025; 9 pages.
Non-Final Office Action dated Apr. 29, 2026 issued in U.S. Appl. No. 18/859,461 (9 pages).

* cited by examiner

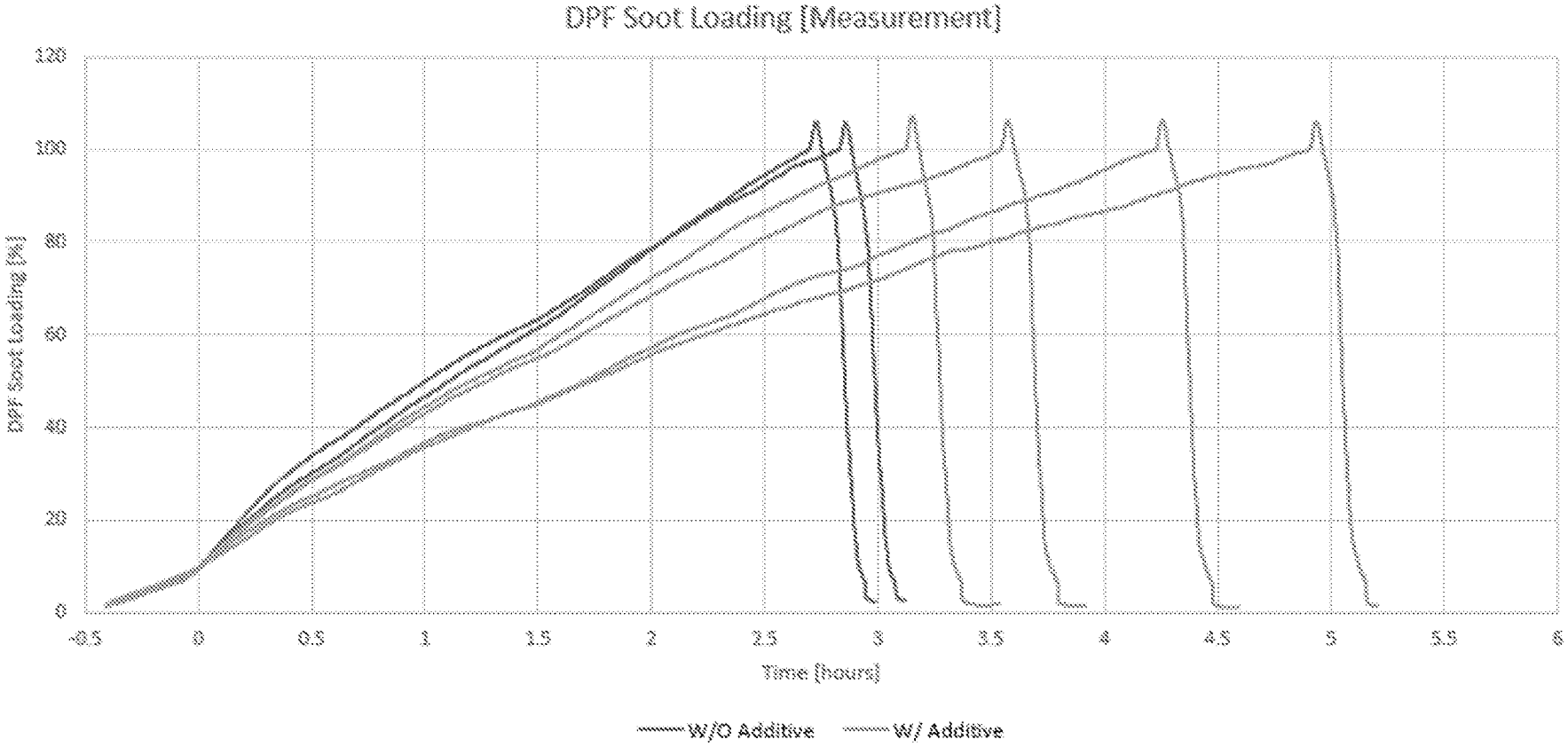
DPF Soot Loading [Measurement]
DPF Soot Loading [%]
120
100
80
60
40
20
0
-0.5
0
0.5
1
1.5
2
2.5
3
3.5
4
4.5
5
5.5
6
Time [hours]
W/O Additive
W/ Additive

USE AND METHOD

TECHNICAL FIELD AND BACKGROUND

The present invention relates to methods and uses for improving the performance of diesel engines. In particular the invention relates to reducing the impact of deposits in the post combustion system of diesel engines, especially modern diesel engines having a high pressure fuel system.

The addition of detergent additives to combat deposits in the combustion system of diesel engines, for example in the fuel injection system, is well known and a wide variety of detergents have been developed for this purpose.

However less work has been carried out to combat deposits in the exhaust gas recirculation system or the post combustion system. Nevertheless, the presence of deposits in the exhaust gas recirculation system or the post combustion system of a diesel engine can have a significant deleterious effect on the performance of diesel engines, especially modern diesel engines having a high pressure fuel system.

Exhaust gas recirculation (EGR) systems are fitted to diesel vehicles to reduce NOx emissions. This is achieved by recirculating exhaust gases to the combustion chamber in a controlled manner and thereby increasing the heat capacity of and reducing the oxygen concentration in gases within the combustion chamber. Several types of EGR systems have been developed. High pressure EGR systems are arranged to divert exhaust gases from the combustion chamber, before the exhaust gases reach any turbocharger and/or diesel particulate filter present in the engine, and supply said exhaust gases to the intake manifold downstream of the compressor. The high pressure EGR system therefore operates on the high pressure sides of the intake and exhaust manifolds and supplies the combustion chamber with unfiltered recirculated exhaust gases. Low pressure EGR systems are arranged to divert exhaust gases from the combustion chamber downstream of any turbocharger and/or diesel particulate filter present in the engine, and to supply said exhaust gases to the intake tract upstream of the compressor. The low pressure EGR system therefore operates on the low pressure sides of the intake and exhaust manifolds and supplies the combustion chamber with filtered recirculated exhaust gases. Hybrid (or combined) EGR systems integrate both high pressure EGR and low pressure EGR on the same engine, to combine the benefits of each system. Dedicated EGR (D-EGR) systems are arranged to route the entire exhaust of a sub-group of power cylinders (dedicated cylinders) directly into the intake manifold.

Over time deposits can form within an EGR system. This is a particular issue in diesel engines with high pressure EGR systems, due to the recirculated exhaust gas stream being taken upstream of any turbocharger and diesel particulate filter, meaning that problematic particulate combustion products are re-introduced into the intake manifold and the combustion chamber. One area where such deposits cause a particular problem is within the cooler component of the EGR system. If the level of deposits becomes significant then the engine management systems in sophisticated diesel engines may cause the engine to operate with reduced performance and/or enter into a safe running mode. This scenario would have significant impact on the vehicle's operability and would require inspection by a suitably qualified workshop.

A typical EGR system comprises an intake pipe, a valve, a housing, a cooler and an outlet pipe. Deposits build up on the interior surfaces of all portions of the EGR system, but particularly in the cooler.

SUMMARY

It would be beneficial to combat such deposits, particularly in the cooler of an EGR system, particularly in the cooler of a high pressure EGR system.

The post combustion system of a diesel engine typically includes a series of components through which exhaust gases must flow before exiting the vehicle. The post combustion system may include a turbocharger, a diesel oxidation catalyst, a diesel particulate filter, a selective catalytic reduction unit and an ammonia oxidation catalyst. It would be desirable to combat deposits in any or all of these components.

The formation of deposits in the post combustion system may involve the accumulation of soot on components of the post combustion system. In particular, the formation of deposits in the post combustion system may involve an accumulation and/or capture of soot in a diesel particulate filter of the post combustion system.

It would also be beneficial to prevent and/or to remove deposits on sensors within the post combustion system, for example deposits on NOx sensors, temperature sensors and/or pressure sensors.

It would also be beneficial to prevent and/or to remove the accumulation of soot on components of the post combustion system and/or to prevent and/or to remove soot from a diesel particulate filter of the post combustion system.

BRIEF DECRYPTION OF THE DRAWINGS

FIG. 1 depicts soot lading results over a predetermined time period.

DETAILED DESCRIPTION

The present inventors have surprisingly found that the inclusion of certain compounds as fuel additives is able to combat the effect of deposits in the EGR system and/or the post combustion system.

According to a first aspect of the present invention there is provided the use of a one or more nitrogen containing detergents as an additive in a diesel fuel composition to reduce the impact of deposits in the exhaust gas recirculation system and/or the post combustion system of a diesel engine when combusting said diesel fuel composition.

According to a second aspect of the present invention there is provided a method of reducing the impact of deposits in the exhaust gas recirculation system and/or the post combustion system of a diesel engine, the method comprising combusting in the engine a diesel fuel composition comprising as an additive one or more nitrogen containing detergents.

The present invention relates to a method and use which reduces the impact of deposits in the EGR system and/or the post combustion system of a diesel engine. The presence of deposits on one or more parts of the post combustion system of a diesel engine typically has a negative effect on the performance of the engine.

Reducing the impact of deposits may involve reducing or preventing the formation of deposits and/or removing existing deposits and/or changing the nature of the deposits.

In some embodiments reducing the impact of deposits may involve changing the nature of deposits. This means that the structure or composition of deposits which are formed is different in a way that is less detrimental to the performance of the engine, for example by increasing the combustibility and/or thermal conductivity of the deposits.

In some preferred embodiments reducing the impact of deposits involves reducing and/or preventing the formation of deposits and/or the removal of existing deposits.

In some embodiments the first aspect of the present invention provides the use of one or more nitrogen containing detergents as an additive in a diesel fuel composition to reduce the impact of deposits in the exhaust gas recirculation system of a diesel engine when combusting said diesel fuel composition.

Preferably the use reduces the formation of deposits in the EGR system.

In some embodiments the second aspect of the present invention provides a method of reducing the impact of deposits in the exhaust gas recirculation system of a diesel engine, the method comprising combusting in the engine a diesel fuel composition comprising as an additive one or more nitrogen containing detergents.

Preferably the method reduces the formation of deposits in the EGR system.

Preferably the first aspect of the present invention provides the use of one or more nitrogen containing detergents as an additive in a diesel fuel composition to reduce the impact of deposits in the post combustion system of a diesel engine when combusting said diesel fuel composition.

Preferably the second aspect of the present invention provides a method of reducing the formation of deposits in the post combustion system of a diesel engine, the method comprising combusting in the engine a diesel fuel composition comprising as an additive one or more nitrogen containing detergents.

In preferred embodiments reducing the impact of deposits involves reducing and/or preventing the impact of deposits in the post combustion system of a diesel engine.

Preferred features of the first and second aspects of the invention will now be described.

The present invention relates to the use of one or more nitrogen containing detergents as an additive in a diesel fuel composition to reduce the impact of deposits in the EGR system and/or the post combustion system.

The present invention involves the use of one or more nitrogen containing detergents as an additive. By this we mean that the invention may include the use of one nitrogen containing detergent as an additive or the use of multiple nitrogen containing detergents as multiple additives.

For the avoidance of doubt each additive used in the present invention may comprise a mixture of compounds and references to an additive or the additive include mixtures, unless otherwise stated. In particular mixtures of isomers and mixtures of homologues are within the scope of the invention. The skilled person will appreciate that commercial sources of some of the additive compounds described herein may comprise mixtures of isomers and/or mixtures of homologues.

The invention relates to the use of one or more nitrogen containing detergents. Preferably the one or more nitrogen containing detergents are selected from:

(a) a quaternary ammonium salt additive;
(b) the reaction product of a carboxylic acid-derived acylating agent and an amine;
(c) the product of a Mannich reaction between an aldehyde, an amine and an optionally substituted phenol;
(d) the reaction product of a carboxylic acid-derived acylating agent and hydrazine;
(e) a salt formed by the reaction of a carboxylic acid with di-n-butylamine or tri-n-butylamine; and
(f) the reaction product of a hydrocarbyl-substituted dicarboxylic acid or anhydride and an amine compound or salt which product comprises at least one amino triazole group.

The one or more nitrogen containing detergents are preferably selected from:

(a) quaternary ammonium salt additives;
(b) the reaction product of a carboxylic acid-derived acylating agent and an amine;
(c) the product of a Mannich reaction between an aldehyde, an amine and an optionally substituted phenol; and
(d) mixtures thereof.

(a) Quaternary Ammonium Salt Additives

Component (a) may comprise any suitable quaternary ammonium salt additive.

Preferably the quaternary ammonium salt additive is the reaction product of a compound including a tertiary amine group and a quaternising agent.

Any suitable quaternising agent may be used. The quaternising agent may suitably be selected from esters and non-esters.

Suitable quaternising agents include esters of a carboxylic acid, dialkyl sulfates, benzyl halides, hydrocarbyl substituted carbonates, hydrocarbyl substituted epoxides optionally in combination with an acid, alkyl halides, alkyl sulfonates, sultones, hydrocarbyl substituted phosphates, hydrocarbyl substituted borates, alkyl nitrites, alkyl nitrates, hydroxides, N-oxides, chloroacetic acid or salts thereof, or mixtures thereof.

In some preferred embodiments, quaternising agents used to form the quaternary ammonium salt additives of the present invention are esters.

Preferred ester quaternising agents are compounds of formula (I):

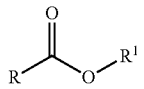

(I)

in which R is an optionally substituted alkyl, alkenyl, aryl or alkylaryl group and $R^1$ is a C1 to C22 alkyl, aryl or alkylaryl group. The compound of formula (I) is suitably an ester of a carboxylic acid capable of reacting with a tertiary amine to form a quaternary ammonium salt.

Suitable quaternising agents include esters of carboxylic acids having a pKa of 3.5 or less.

The compound of formula (I) is preferably an ester of a carboxylic acid selected from a substituted aromatic carboxylic acid, an α-hydroxycarboxylic acid and a polycarboxylic acid.

In some preferred embodiments the compound of formula (I) is an ester of a substituted aromatic carboxylic acid and thus R is a substituted aryl group.

Preferably R is a substituted aryl group having 6 to 10 carbon atoms, preferably a phenyl or naphthyl group, most preferably a phenyl group. R is suitably substituted with one or more groups selected from carboalkoxy, nitro, cyano, hydroxy, $SR^5$ or $NR^5R^6$. Each of $R^5$ and $R^6$ may be hydrogen or optionally substituted alkyl, alkenyl, aryl or carboalkoxy groups. Preferably each of $R^5$ and $R^6$ is hydrogen or an optionally substituted C1 to C22 alkyl group, preferably hydrogen or a C1 to C16 alkyl group, preferably hydrogen or a C1 to C10 alkyl group, more preferably hydrogen or a C1 to C4 alkyl group. Preferably $R^5$ is hydrogen and $R^6$ is hydrogen or a C1 to C4 alkyl group. Most preferably $R^5$ and $R^6$ are both hydrogen. Preferably R is an aryl group substituted with one or more groups selected from hydroxyl, carboalkoxy, nitro, cyano and $NH_2$. R may be a poly-substituted aryl group, for example trihydroxyphenyl. In some embodiments R may be a hydrocarbyl substituted aryl group, for example an alkyl substituted aryl group. In some embodiments R may be an aryl group substituted with a hydroxy group and a hydrocarbyl group, such as an alkyl group, for example as described in EP2631283.

Preferably R is a mono-substituted aryl group. Preferably R is an ortho substituted aryl group. Suitably R is substituted with a group selected from OH, $NH_2$, $NO_2$ or COOMe. Preferably R is substituted with an OH or $NH_2$ group. Suitably R is a hydroxy substituted aryl group. Most preferably R is a 2-hydroxyphenyl group.

Preferably $R^1$ is an alkyl, aralkyl or alkaryl group. $R^1$ may be a C1 to C16 alkyl group, preferably a C1 to C10 alkyl group, suitably a C1 to C8 alkyl group. $R^1$ may be C7 to C16 aralkyl or alkaryl group, preferably a C7 to C10 aralkyl or alkaryl group. $R^1$ may be methyl, ethyl, propyl, butyl, pentyl, benzyl or an isomer thereof. Preferably $R^1$ is benzyl or methyl. Most preferably $R^1$ is methyl.

Especially preferred compounds of formula (I) are lower alkyl esters of salicylic acid such as methyl salicylate, ethyl salicylate, n- and i-propyl salicylate, and butyl salicylate, preferably methyl salicylate.

In some embodiments the compound of formula (I) is an ester of an α-hydroxycarboxylic acid. In such embodiments the compound has the structure:

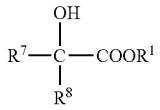

wherein $R^7$ and $R^8$ are the same or different and each is selected from hydrogen, alkyl, alkenyl, aralkyl or aryl. Compounds of this type suitable for use herein are described in EP1254889.

Examples of compounds of formula (I) in which RCOO is the residue of an α-hydroxycarboxylic acid include methyl-, ethyl-, propyl-, butyl-, pentyl-, hexyl-, benzyl-, phenyl-, and allyl esters of 2-hydroxyisobutyric acid; methyl-, ethyl-, propyl-, butyl-, pentyl-, hexyl-, benzyl-, phenyl-, and allyl esters of 2-hydroxy-2-methylbutyric acid; methyl-, ethyl-, propyl-, butyl-, pentyl-, hexyl-, benzyl-, phenyl-, and allyl esters of 2-hydroxy-2-ethylbutyric acid; methyl-, ethyl-, propyl-, butyl-, pentyl-, hexyl-, benzyl-, phenyl-, and allyl esters of lactic acid; and methyl-, ethyl-, propyl-, butyl-, pentyl-, hexyl-, allyl-, benzyl-, and phenyl esters of glycolic acid. Of the above, a preferred compound is methyl 2-hydroxyisobutyrate.

In some embodiments the compound of formula (I) is an ester of a polycarboxylic acid. In this definition we mean to include dicarboxylic acids and carboxylic acids having more than 2 acidic moieties. In such embodiments RCOO is preferably present in the form of an ester, that is the one or more further acid groups present in the group R are in esterified form. However embodiments in which not all acid groups are esterified are within the invention. Mixed esters of polycarboxylic acids may also be used. Preferred esters are C1 to C4 alkyl esters.

The ester quaternising agent may be selected from the diester of oxalic acid, the diester of phthalic acid, the diester of maleic acid, the diester of malonic acid or the diester of citric acid. One especially preferred compound of formula (I) is dimethyl oxalate.

In preferred embodiments the compound of formula (I) is an ester of a carboxylic acid having a pKa of less than 3.5. In such embodiments in which the compound includes more than one acid group, we mean to refer to the first dissociation constant.

The ester quaternising agent may be selected from an ester of a carboxylic acid selected from one or more of oxalic acid, phthalic acid, salicylic acid, maleic acid, malonic acid, citric acid, nitrobenzoic acid, aminobenzoic acid, 2,4,6-trihydroxybenzoic acid, succinic acid, glutaric acid, adipic acid, fumaric acid, acetylene dicarboxylic acid, glutaconic acid, muconic acid, citraconic acid, mesaconic acid, itaconic acid, tartronic acid, mesoxalic acid, tartaric acid, oxaloacetic acid, dioxosuccinic acid, alpha-hydroxyglutaric acid, diphenic acid and 2,6-naphthalenedicarboxylic acid.

The ester quaternising agent may be selected from an ester of a carboxylic acid selected from one or more of oxalic acid, phthalic acid, salicylic acid, maleic acid, malonic acid, citric acid, nitrobenzoic acid, aminobenzoic acid and 2,4,6-trihydroxybenzoic acid.

Preferred ester quaternising agents include dimethyl oxalate, methyl 2-nitrobenzoate and methyl salicylate.

In some preferred embodiments, quaternising agents used to form the quaternary ammonium salt additives of the present invention are esters selected from dimethyl oxalate, methyl 2-nitrobenzoate and methyl salicylate, preferably dimethyl oxalate and methyl salicylate.

Suitable non-ester quaternising agents include dialkyl sulfates, benzyl halides, hydrocarbyl substituted carbonates, hydrocarbyl substituted epoxides optionally in combination with an acid, alkyl halides, alkyl sulfonates, sultones, hydrocarbyl substituted phosphates, hydrocarbyl substituted borates, alkyl nitrites, alkyl nitrates, hydroxides, N-oxides, chloroacetic acid or salts thereof, or mixtures thereof.

Preferred non-ester quaternising agents include dialkyl sulfates, benzyl halides, hydrocarbyl substituted carbonates, hydrocarbyl substituted epoxides in combination with an acid, alkyl halides, alkyl sulfonates, sultones, hydrocarbyl substituted phosphates, hydrocarbyl substituted borates, N-oxides, chloroacetic acid or salts thereof, or mixtures thereof.

In some embodiments the quaternary ammonium salt may be prepared from, for example, an alkyl or benzyl halide (especially a chloride) and then subjected to an ion exchange reaction to provide a different anion as part of the quaternary ammonium salt. Such a method may be suitable to prepare quaternary ammonium hydroxides, alkoxides, nitrites or nitrates.

Suitable alkyl halides for use herein include chlorides, bromides and iodides.

Suitable benzyl halides include chlorides, bromides and iodides. The phenyl group may be optionally substituted, for example with one or more alkyl or alkenyl groups, especially when the chlorides are used. A preferred compound is benzyl bromide.

Suitable dialkyl sulfates for use herein as quaternising agents include those including alkyl groups having 1 to 10, preferably 1 to 4 carbons atoms in the alkyl chain. A preferred compound is dimethyl sulfate.

Suitable hydrocarbyl substituted carbonates may include two hydrocarbyl groups, which may be the same or different.

Each hydrocarbyl group may contain from 1 to 50 carbon atoms, preferably from 1 to 20 carbon atoms, more preferably from 1 to 10 carbon atoms, suitably from 1 to 5 carbon atoms.

Preferably the or each hydrocarbyl group is an alkyl group. Preferred compounds of this type include diethyl carbonate and dimethyl carbonate.

Suitable hydrocarbyl substituted epoxides have the formula:

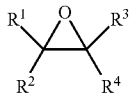

wherein each of $R^1$, $R^2$, $R^3$ and $R^4$ is independently hydrogen or a hydrocarbyl group having 1 to 50 carbon atoms. Examples of suitable epoxides include ethylene oxide, propylene oxide, butylene oxide, styrene oxide and stilbene oxide. The hydrocarbyl epoxides are used as quaternising agents in combination with an acid.

In some embodiments the compound including a tertiary amine group also includes an acid functional group. In these embodiments if an epoxide is used as the quaternising agent, a separate acid does not need to be added. However in other embodiments an acid, for example acetic acid, may be used.

Especially preferred epoxide quaternising agents are propylene oxide and styrene oxide, optionally in combination with an additional acid.

Suitable alkyl sulfonates include those having 1 to 20, preferably 1 to 10, more preferably 1 to 4 carbon atoms.

Suitable sultones include propane sultone and butane sultone.

Suitable hydrocarbyl substituted phosphates include monoalkyl phosphates, dialkyl phosphates, trialkyl phosphates and O,O-dialkyl dithiophospates. Preferred alkyl groups have 1 to 12 carbon atoms.

Suitable hydrocarbyl substituted borate groups include alkyl borates having 1 to 12 carbon atoms.

Preferred alkyl nitrites and alkyl nitrates have 1 to 12 carbon atoms.

Preferably the non-ester quaternising agent is selected from dialkyl sulfates, benzyl halides, hydrocarbyl substituted carbonates, hydrocarbyl substituted epoxides optionally in combination with an additional acid, chloroacetic acid or a salt thereof, and mixtures thereof.

Especially preferred non-ester quaternising agents for use herein are hydrocarbyl substituted epoxides in combination with an acid. These may include embodiments in which a separate acid is provided or embodiments in which the acid is provided by the tertiary amine compound that is being quaternised. Preferably the acid is provided by the tertiary amine molecule that is being quaternised.

Preferred quaternising agents for use herein include dimethyl oxalate, methyl 2-nitrobenzoate, methyl salicylate, chloroacetic acid or a salt thereof, and styrene oxide or propylene oxide optionally in combination with an additional acid.

In some embodiments mixtures of two or more quaternising agents may be used.

To form the quaternary ammonium salt additive the quaternising agent is reacted with a compound including a tertiary amine group.

Any suitable compound including a tertiary amine group may be used.

The compound including at least one tertiary amine group may be selected from:

(i) the reaction product of a hydrocarbyl-substituted acylating agent and a compound comprising at least one tertiary amine group and a primary amine, secondary amine or alcohol group;

(ii) a Mannich reaction product comprising a tertiary amine group;

(iii) a polyalkylene substituted amine having at least one tertiary amine group; and (iv) simple alkylamines and alkanolamines.

Examples of quaternary ammonium salt and methods for preparing the same are described in the following patents: US2008/0307698, US2008/0052985, US2008/0113890 and US2013/031827.

The preparation of some suitable quaternary ammonium salt additives in which the compound including at least one tertiary amine group includes component (i) is described in WO2006/135881, US2020/0024536 and WO2011/095819.

Component (ii) is a Mannich reaction product having a tertiary amine. The preparation of quaternary ammonium salts in which the compound including at least one tertiary amine group includes component (ii) is described in US 2008/0052985.

The preparation of quaternary ammonium salt additives in which the compound including at least one tertiary amine group includes component (iii) is described for example in US2008/0113890.

The preparation of some suitable quaternary ammonium salt additives in which the compound including at least one tertiary amine group includes component (i) is described, for example in WO2016/016641.

Other suitable quaternary ammonium salts include quaternised terpolymers, for example as described in US2011/0258917; quaternised copolymers, for example as described in US2011/0315107; and the acid-free quaternised nitrogen compounds disclosed in US2012/0010112.

In some embodiments the present invention does not encompass acid-free quaternised nitrogen compounds. In preferred embodiments the quaternary ammonium salt additives of the invention include a separate anion and a separate cation.

In some embodiments wherein the compound including at least one tertiary amine group is (i) the reaction product of a hydrocarbyl-substituted acylating agent and a compound comprising at least one tertiary amine group and a primary amine, secondary amine or alcohol group, the hydrocarbyl-substituted acylating agent may be provided by a fatty acid. Suitable fatty acids are compounds of formula RCOOH in which R is an alkyl or alkenyl group having 6 to 36 carbon atoms, preferably 8 to 30 carbon atoms or 12 to 24 carbon atoms. One preferred fatty acid is oleic acid.

In such embodiments, the compound comprising at least one tertiary amine group and a primary amine, secondary amine or alcohol group is suitably provided by a compound of formula (II) or (III):

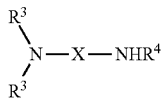

(II)

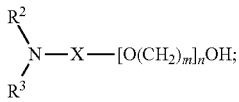

(III)

wherein $R^2$ and $R^3$ are the same or different alkyl, alkenyl, aryl, alkaryl or aralkyl groups having from 1 to 22 carbon atoms; X is a bond or an optionally substituted alkylene group having from 1 to 20 carbon atoms; n is from 0 to 20; m is from 1 to 5; and $R^4$ is hydrogen or a $C_1$ to $C_{22}$ alkyl group.

Suitable compounds according to formula (II) may be selected from N,N-dimethyl-1,3-diaminopropane, N,N-diethyl-1,3-diaminopropane, N,N-dimethylethylenediamine, N,N-diethylethylenediamine, N,N-dibutylethylenediamine, 3-(2-(dimethylamino)ethoxy) propylamine, or combinations thereof. In some preferred embodiments, the compound comprising at least one tertiary amine group and a primary amine, secondary amine or alcohol group is dimethylaminopropyl amine.

Preferably, the quaternary ammonium salt additives are the quaternised reaction product of a fatty acid, for example of formula RCOOH in which R is an alkyl or alkenyl group having 12 to 24 carbon atoms, and a compound of formula (II), suitably wherein both $R^2$ and $R^3$ are $C_1$ to $C_4$ alkyl groups and X is alkylene group having from 2 to 5 carbon atoms.

In such embodiments the quaternary ammonium compounds for use in the present invention are the quaternised reaction product of a fatty acid (for example oleic acid) and dimethylaminopropyl amine.

The term "quaternary ammonium compounds" is used herein interchangeably with "quaternary ammonium salt additive" and "quaternary ammonium salt". Therefore in such embodiments the quaternary ammonium compounds for use in the present invention are the quaternised reaction product of a fatty acid (for example oleic acid) and dimethylaminopropyl amine.

Preferably, the quaternary ammonium salt additive is the quaternised reaction product of oleic acid and dimethylaminopropyl amine.

In such embodiments, suitable quaternising agents for reaction with the reaction product described above are dialkyl sulfates, benzyl halides, hydrocarbyl substituted carbonates, hydrocarbyl substituted epoxides in combination with an acid, alkyl halides, alkyl sulfonates, sultones, hydrocarbyl substituted phosphates, hydrocarbyl substituted borates, N-oxides, chloroacetic acid or salts thereof, or mixtures thereof. Preferably the quaternising agent is chloroacetic acid or salts thereof, for example sodium chloroacetate.

In such embodiments, the quaternary ammonium salt additive may have the formula (IV):

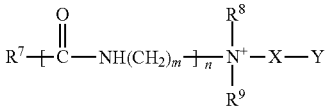

(IV)

wherein $R^7$ is alkyl or alkenyl of 7 to 22 carbon atoms; $R^8$ and $R^9$ are each independently alkyl, hydroxyalkyl or carboxyalkyl of 1 to 6 carbon atoms; m is 2 to 4; n is 0 or 1; X is alkylene of 1 to 6 carbon atoms optionally substituted with hydroxyl; and Y is $—CO_2$ or $—SO_3$.

Preferably the quaternary ammonium salt additive is an amido betaine having the formula (V):

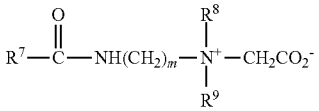

wherein $R^7$, $R^8$ and $R^9$ are as defined above and wherein m is 2 or 3.

Preferably $R^7$ has from 16 to 22 carbon atoms. $R^7$ is preferably an alkenyl group having from 16 to 22 carbon atoms. For example $R^7$ may be a $C_{17}$ alkenyl group derived from oleic acid. $R^8$ and $R^9$ are preferably methyl.

In one preferred embodiment, the quaternary ammonium salt additive is the quaternised reaction product of oleic acid and dimethylaminopropyl amine, wherein the reaction product has been quaternised with chloroacetic acid or salts thereof.

Further suitable quaternary ammonium salt additives for use in the present invention include the quaternary ammonium salt additives described in the applicant's copending applications WO2011/095819, WO2013/017889, WO2015/011506, WO2015/011507, WO2016/016641 and WO2017/017454.

In some embodiments wherein the compound including at least one tertiary amine group is (i) the reaction product of a hydrocarbyl-substituted acylating agent and a compound comprising at least one tertiary amine group and a primary amine, secondary amine or alcohol group, the hydrocarbyl-substituted acylating agent may be provided by a hydrocarbyl substituted succinic acid derived acylating agent.

In such embodiments, the quaternary ammonium salt additive (a) is the quaternised reaction product of a hydrocarbyl substituted succinic acid derived acylating agent and a compound able to react with said acylating agent and which includes a tertiary amine group.

For the avoidance of doubt reference to the quaternised reaction product is meant to refer to a reaction product which comprises the tertiary amine which has then been quaternised to form a quaternary ammonium group. The quaternary ammonium salt additive is formed by reacting a quaternising agent with the reaction product of a hydrocarbyl substituted succinic acid derived acylating agent and a compound able to react with said acylating agent and which includes a tertiary amine group.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(i) hydrocarbon groups, that is, aliphatic (which may be saturated or unsaturated, linear or branched, e.g., alkyl or alkenyl), alicyclic (e.g., cycloalkyl, cycloalkenyl) substituents, and aromatic (including aliphatic- and alicyclic-substituted aromatic) substituents, as well as cyclic substituents wherein the ring is completed through another portion of the molecule (e.g., two substituents together form a ring);

(ii) substituted hydrocarbon groups, that is, substituents containing non-hydrocarbon groups which, in the context of this invention, do not alter the predominantly hydrocarbon nature of the substituent (e.g., halo (e.g. chloro, fluoro or bromo), hydroxy, alkoxy (e.g. $C_1$ to $C_4$ alkoxy), keto, acyl, cyano, mercapto, amino, amido, nitro, nitroso, sulfoxy, nitryl and carboxy);

(iii) hetero substituents, that is, substituents which, while having a predominantly hydrocarbon character, in the context of this invention, contain other than carbon in a ring or chain otherwise composed of carbon atoms. Heteroatoms include sulphur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

Suitable hydrocarbyl substituted succinic acid derived acylating agents and means of preparing them are well known in the art. For example a common method of preparing a hydrocarbyl substituted succinic acylating agent is by the reaction of maleic anhydride with an olefin using a chlorination route or a thermal route (the so-called "ene" reaction).

Illustrative of hydrocarbyl substituent based groups include n-octyl, n-decyl, n-dodecyl, tetrapropenyl, n-octadecyl, oleyl, chloroctadecyl, triicontanyl, etc. The hydrocarbyl based substituents may be made from homo- or interpolymers (e.g. copolymers, terpolymers) of mono- and di-olefins having 2 to 10 carbon atoms, for example ethylene, propylene, butane-1, isobutene, butadiene, isoprene, 1-hexene, 1-octene, etc. Preferably these olefins are 1-monoolefins. Alternatively the substituent may be made from other sources, for example monomeric high molecular weight alkenes (e.g. 1-tetra-contene), aliphatic petroleum fractions, for example paraffin waxes and cracked analogs thereof, white oils, synthetic alkenes for example produced by the Ziegler-Natta process (e.g. poly(ethylene) greases) and other sources known to those skilled in the art. Any unsaturation in the substituent may if desired be reduced or eliminated by hydrogenation according to procedures known in the art.

Preferably the hydrocarbyl substituents are predominantly saturated, that is, they contain no more than one carbon-to-carbon unsaturated bond for every ten carbon-to-carbon single bonds present. Most preferably they contain no more than one carbon-to-carbon non-aromatic unsaturated bond for every 50 carbon-to-carbon bonds present.

The hydrocarbyl substituent of the succinic acid derived acylating agent preferably comprises at least 10, more preferably at least 12, for example at least 30 or at least 40 carbon atoms. It may comprise up to about 200 carbon atoms. Preferably the hydrocarbyl substituent of the acylating agent has a number average molecular weight (Mn) of between 170 to 2800, for example from 250 to 1500, preferably from 500 to 1500 and more preferably 500 to 1100. An Mn of 700 to 1300 is especially preferred.

The skilled person would be familiar with standard techniques to measure number average molecular weight, such as by vapor pressure osmometry, end-group titration, proton NMR, boiling point elevation, freezing depression (cryoscopy), and GPC (gel permeation chromatography).

The hydrocarbyl substituted succinic acid derived acylating agent may comprise a mixture of compounds. For example a mixture of compounds having different hydrocarbyl substituents may be used.

Preferred hydrocarbyl-based substituents are polyisobutenes. Such compounds are known to the person skilled in the art.

Preferred hydrocarbyl substituted succinic acid derived acylating agents are polyisobutenyl succinic anhydrides. These compounds are commonly referred to as "PIBSAs" and are known to the person skilled in the art.

Conventional polyisobutenes and so-called "highly-reactive" polyisobutenes are suitable for use in the invention. Highly reactive polyisobutenes in this context are defined as polyisobutenes wherein at least 50%, preferably 70% or more, of the terminal olefinic double bonds are of the vinylidene type as described in EP0565285. Particularly preferred polyisobutenes are those having more than 80 mol % and up to 100 mol % of terminal vinylidene groups such as those described in U.S. Pat. No. 7,291,758.

Preferred polyisobutenes have preferred molecular weight (Mn) ranges as described above for hydrocarbyl substituents generally.

Other preferred hydrocarbyl groups include those having an internal olefin for example as described in the applicant's published application WO2007/015080.

An internal olefin as used herein means any olefin containing predominantly a non-alpha double bond, that is a beta or higher olefin. Preferably such materials are substantially completely beta or higher olefins, for example containing less than 10% by weight alpha olefin, more preferably less than 5% by weight or less than 2% by weight. Typical internal olefins include Neodene 151810 available from Shell.

Internal olefins are sometimes known as isomerised olefins and can be prepared from alpha olefins by a process of isomerisation known in the art, or are available from other sources. The fact that they are also known as internal olefins reflects that they do not necessarily have to be prepared by isomerisation.

Preferred hydrocarbyl substituted succinic acid derived acylating agents for use in preparing additive (a) of the present invention are polyisobutenyl substituted succinic anhydrides or PIBSAs. Especially preferred PIBSAs are those having a PIB molecular weight (Mn) of from 300 to 2800, preferably from 450 to 2300, more preferably from 500 to 1300.

The hydrocarbyl substituted succinic acid derived acylating agent is suitably prepared by reacting maleic anhydride with an alkene, for example a polyisobutene. The product obtained (such as a PIBSA) still includes a double bond. The maleic anhydride is present in the resultant molecule as a succinic acid moiety. This initial product is a monomaleated PIBSA.

The monomaleated PIBSA may have the structure (A) or (B):

(A)

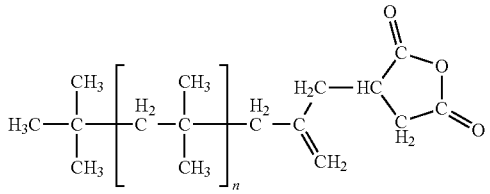

(B)

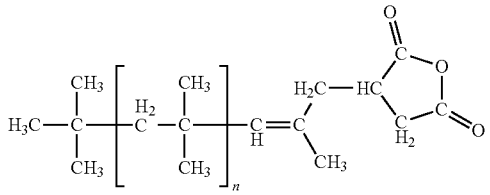

The double bond in the monomaleated product can react with a further molecule of maleic anhydride to form a bismaleated PIBSA having the structure (C) or (D):

(C)

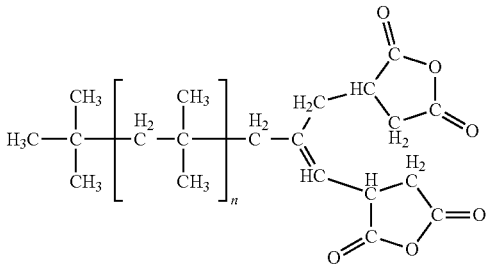

(D)

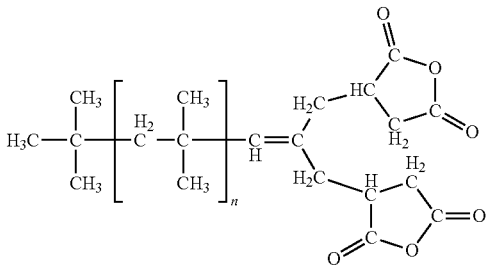

Thus it is possible to provide a hydrocarbyl group which is substituted with more than one succinic acid moiety.

The skilled person will appreciate that the additives used in the invention typically comprise mixtures of compounds and will be prepared from a mixture of monomaleated and bismaleated PIBSAs. The PIBSAs may be defined in terms of their level of bismaleation.

One way in which this may be determined is by calculating the average number of succinic acid moieties per molecule of acylating agent.

A monomaleated PIBSA has one succinic acid moiety per module.

A bismaleated PIBSA has two succinic acid moieties per molecule.

A mixture comprising monomaleated PIBSA and bismaleated PIBSA in a 1:1 molar ratio would comprise an average of 1.5 succinic acid moieties per molecule of PIBSA.

The average number of succinic acid moieties per molecule of acylating agent is sometimes referred to in the art as "P value".

Suitably the quaternary ammonium salt additive is prepared from a hydrocarbyl substituted succinic acid derived acylating agent comprising on average from 1 to 2 succinic acid moieties per molecule.

In some preferred embodiments the present invention may involve the use of quaternary ammonium salts derived from hydrocarbyl substituted acylating agents which include an average of at least 1.2 succinic acid moieties per molecule.

As the skilled person will appreciate, a single molecule cannot have 1.2 succinic acid moieties. What is meant by at least 1.2 succinic acid moieties is the mean number of succinic acid moieties per molecule of acylating agent as the sum of all the succinic acid moieties present in a sample divided by the total number of molecules of acylating agent having one or more succinic acid moieties present in the sample.

Preferably the hydrocarbyl substituted succinic acid derived acylating agent comprises on average at least 1.21 succinic acid moieties per molecule, more preferably at least 1.22 succinic acid moieties per molecule.

In some embodiments the hydrocarbyl substituted succinic acid derived acylating agent may comprise at least 1.23 or at least 1.24 succinic acid moieties per molecule.

In some embodiments the hydrocarbyl substituted succinic acid derived acylating agent may comprise at least 1.25, at least 1.26 or at least 1.27 succinic acid moieties per molecule.

In some embodiments the hydrocarbyl substituted succinic acid derived acylating agent may comprise at least 1.28, at least 1.29 or at least 1.30 succinic acid moieties per molecule.

By succinic acid moiety we mean to include residues of succinic acid present in diacid or anhydride form.

The hydrocarbyl substituted succinic acid derived acylating agent is reacted with a compound able to react with said acylating agent and which includes a tertiary amine group. The tertiary amine group is quaternised to provide the quaternary ammonium salt additive.

Examples of suitable compounds able to react with the hydrocarbyl substituted succinic acid derived acylating agent and which include a tertiary amine group can include but are not limited to: N,N-dimethylaminopropylamine, N,N-diethylaminopropylamine, N,N-dimethylamino ethylamine. The nitrogen or oxygen containing compounds capable of condensing with the acylating agent and further having a tertiary amino group can further include amino alkyl substituted heterocyclic compounds such as 1-(3-aminopropyl)imidazole and 4-(3-aminopropyl)morpholine, 1-(2-aminoethyl)piperidine, 3,3-diamino-N-methyldipropylamine, and 3'3-aminobis(N,N-dimethylpropylamine). Other types of nitrogen or oxygen containing compounds capable of condensing with the acylating agent and having a tertiary amino group include alkanolamines including but not limited to triethanolamine, trimethanolamine, N,N-dimethylaminopropanol, N,N-dimethylaminoethanol, N,N-diethylaminopropanol, N,N-diethylaminoethanol, N,N-diethylaminobutanol, N,N,N-tris(hydroxyethyl)amine, N,N,N-tris(hydroxymethyl)amine, N,N,N-tris(aminoethyl)amine, N,N-dibutylaminopropylamine and N,N,N'-trimethyl-N'-hydroxyethyl-bisaminoethylether; N,N-bis(3-dimethylaminopropyl)-N-isopropanolamine; N-(3-dimethylaminopropyl)-N,N-diisopropanolamine; N'-(3-(dimethylamino)propyl)-N,N-dimethyl 1,3-propanediamine; 2-(2-dimethylaminoethoxy)ethanol, N,N,N'-trimethylaminoethylethanolamine and 3-(2-(dimethylamino)ethoxy) propylamine.

Preferably the compound able to react with hydrocarbyl substituted succinic acid derived acylating agent and which includes a tertiary amine group is an amine of formula (II) or (III):

(II)

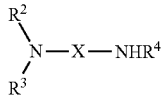

(III)

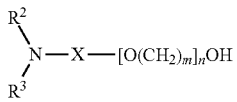

wherein $R^2$ and $R^3$ are the same or different alkyl, alkenyl, aryl, alkaryl or aralkyl groups having from 1 to 22 carbon atoms; X is a bond or an optionally substituted alkylene group having from 1 to 20 carbon atoms; n is from 0 to 20; m is from 1 to 5; and $R^4$ is hydrogen or a $C_1$ to $C_{22}$ alkyl group.

When a compound of formula (II) is used, $R^4$ is preferably hydrogen or a $C_1$ to $C_{16}$ alkyl group, preferably a $C_1$ to $C_{10}$ alkyl group, more preferably a $C_1$ to $C_6$ alkyl group. When $R^4$ is alkyl it may be straight chained or branched. It may be substituted for example with a hydroxy or alkoxy substituent. Preferably $R^4$ is not a substituted alkyl group. More preferably $R^4$ is selected from hydrogen, methyl, ethyl, propyl, butyl and isomers thereof. Most preferably $R^4$ is hydrogen.

When a compound of formula (III) is used, m is preferably 2 or 3, most preferably 2; n is preferably from 0 to 15, preferably 0 to 10, more preferably from 0 to 5. Most preferably n is 0 and the compound of formula (III) is an alcohol.

Preferably the hydrocarbyl substituted acylating agent is reacted with a diamine compound of formula (II).

$R^2$ and $R^3$ are the same or different alkyl, alkenyl, aryl, alkaryl or aralkyl groups having from 1 to 22 carbon atoms. In some embodiments $R^2$ and $R^3$ may be joined together to form a ring structure, for example a piperidine, imidazole or morpholine moiety. Thus $R^2$ and $R^3$ may together form an aromatic and/or heterocyclic moiety. $R^2$ and $R^3$ may be branched alkyl or alkenyl groups. Each may be substituted, for example with a hydroxy or alkoxy substituent.

Preferably each of $R^2$ and $R^3$ is independently a $C_1$ to $C_{16}$ alkyl group, preferably a $C_1$ to $C_{10}$ alkyl group. $R^2$ and $R^3$ may independently be methyl, ethyl, propyl, butyl, pentyl, hexyl, heptyl, octyl, or an isomer of any of these. Preferably $R^2$ and $R^3$ is each independently $C_1$ to $C_4$ alkyl. Preferably $R^2$ is methyl. Preferably $R^3$ is methyl.

X is a bond or an optionally substituted alkylene group having from 1 to 20 carbon atoms. In preferred embodiments when X is an alkylene group this group may be straight chained or branched. The alkylene group may include a cyclic structure therein. It may be optionally substituted, for example with a hydroxy or alkoxy substituent. In some embodiments X may include a heteroatom within the alkylene chain, for example X may include an ether functionality.

X is preferably an alkylene group having 1 to 16 carbon atoms, preferably 1 to 12 carbon atoms, more preferably 1 to 8 carbon atoms, for example 2 to 6 carbon atoms or 2 to 5 carbon atoms. In some preferred embodiments X is an unsubstituted alkylene group. Most preferably X is an ethylene, propylene or butylene group, especially a propylene group.

Examples of compounds of formula (II) suitable for use herein include 1-aminopiperidine, 1-(2-aminoethyl)piperidine, 1-(3-aminopropyl)-2-pipecoline, 1-methyl-(4-methylamino)piperidine, 4-(1-pyrrolidinyl)piperidine, 1-(2-aminoethyl)pyrrolidine, 2-(2-aminoethyl)-1-methylpyrrolidine, N,N-diethylethylenediamine, N,N-dimethylethylenediamine, N,N-dibutylethylenediamine, N,N-diethyl-1,3-diaminopropane, N,N-dimethyl-1,3-diaminopropane, N,N,N'-trimethylethylenediamine, N,N-dimethyl-N'-ethylethylenediamine, N,N-diethyl-N'-methylethylenediamine, N,N,N'-triethylethylenediamine, 3-dimethylaminopropylamine, 3-diethylaminopropylamine, 3-dibutylaminopropylamine, N,N,N'-trimethyl-1,3-propanediamine, N,N,2,2-tetramethyl-1,3-propanediamine, 2-amino-5-diethylaminopentane, N,N,N',N'-tetraethyldiethylenetriamine, 3,3'-diamino-N-methyldipropylamine, 3,3'-iminobis(N,N-dimethylpropylamine), 1-(3-aminopropyl)imidazole and 4-(3-aminopropyl)morpholine, 1-(2-aminoethyl)piperidine, 3,3-diamino-N-methyldipropylamine, 3,3-aminobis(N,N-dimethylpropylamine), 3-(2-(dimethylamino)ethoxy)propylamine, or combinations thereof.

In some preferred embodiments the compound of formula (II) is selected from N,N-dimethyl-1,3-diaminopropane, N,N-diethyl-1,3-diaminopropane, N,N-dimethylethylenediamine, N,N-diethylethylenediamine, N,N-dibutylethylenediamine, 3-(2-(dimethylamino)ethoxy) propylamine, or combinations thereof.

Examples of compounds of formula (III) suitable for use herein include alkanolamines including but not limited to triethanolamine, N,N-dimethylaminopropanol, N,N-diethylaminopropanol, N,N-diethylaminobutanol, triisopropanolamine, 1-[2-hydroxyethyl]piperidine, 2-[2-(dimethylamine)ethoxy]-ethanol, N-ethyldiethanolamine, N-methyldiethanolamine, N-butyldiethanolamine, N,N-diethylaminoethanol, N,N-dimethyl amino-ethanol, 2-dimethylamino-2-methyl-1-propanol, N,N,N'-trimethyl-N'-hydroxyethyl-bisaminoethylether; N,N-bis(3-dimethylaminopropyl)-N-isopropanolamine; N-(3-dimethylaminopropyl)-N,N-diisopropanolamine; N'-(3-(dimethylamino)propyl)-N,N-dimethyl 1,3-propanediamine; 2-(2-dimethylaminoethoxy)ethanol, and N,N,N'-trimethylaminoethylethanolamine.

In some preferred embodiments the compound of formula (III) is selected from Triisopropanolamine, 1-[2-hydroxyethyl]piperidine, 2-[2-(dimethylamine)ethoxy]-ethanol, N-ethyldiethanolamine, N-methyldiethanolamine, N-butyldiethanolamine, N,N-diethylaminoethanol, N,N-dimethylaminoethanol, 2-dimethylamino-2-methyl-1-propanol, or combinations thereof.

An especially preferred compound of formula (II) is N,N-dimethyl-1,3-diaminopropane (dimethylaminopropylamine).

When a compound of formula (III) is reacted with a succinic acylating agent the resulting product is a succinic ester. When a succinic acylating agent is reacted with a compound of formula (II) in which $R^4$ is hydrogen the resulting product may be a succinimide or a succinamide. When a succinic acylating agent is reacted with a compound of formula (II) in which $R^4$ is not hydrogen the resulting product is an amide.

In some embodiments wherein the succinic acylating agent is reacted with a compound comprising a primary amine moiety, for example a compound of formula (II) in which $R^4$ is hydrogen, the reaction may form an amide bond, an imide bond or a mixture thereof. Therefore the reaction product may be a succinimide or a succinamide, or a mixture thereof. Whether a succinimide or a succinamide is formed may depend on the reaction conditions used. The skilled person would be able to select appropriate reaction conditions for forming predominantly the succinimide form or predominantly the succinamide form of the reaction product. The succinamide suitably comprises a free carboxylic acid moiety and an amide bond formed between the succinic acylating agent and the amine compound.

In some preferred embodiments, reaction product of a hydrocarbyl substituted succinic acid derived acylating agent and a compound able to react with said acylating agent and which includes a tertiary amine group (i.e. component (i)) is a succinimide, preferably a polyisobutenyl succinimide (known as a "PIBSI").

In some preferred embodiments, reaction product of a hydrocarbyl substituted succinic acid derived acylating agent and a compound able to react with said acylating agent and which includes a tertiary amine group (i.e. component (i)) is a succinamide, preferably a polyisobutenyl succinamide.

To form the quaternary ammonium salt additive (a) the hydrocarbyl substituted succinic acid derived acylating agent is reacted with a compound able to react with said acylating agent and which includes a tertiary amine group. This reaction product is then quaternised by reaction with a quaternising agent.

The reaction product of the acylating agent and compound which includes a tertiary amine group is preferably reacted with at least one molar equivalent of quaternising agent per mole of tertiary amine group present in the reaction product.

In some embodiments the reaction product of the acylating agent and compound which includes a tertiary amine group may be reacted with more than one molar equivalent of quaternising agent per mole of tertiary amine group present in the reaction product, preferably at least 1.2 molar equivalents of quaternising agent per mole of tertiary amine group, more preferably at least 1.5 molar equivalents of quaternising agent, suitably at least 1.7 molar equivalents of quaternising agent, for example at least 1.9 molar equivalents of quaternising agent.

In some embodiments the reaction product of the acylating agent and compound which includes a tertiary amine group may be reacted with two or more molar equivalents of quaternising agent per mole of tertiary amine group present in the reaction product, preferably at least 2.1 molar equivalents of quaternising agent.

In some embodiments the reaction product of the acylating agent and compound which includes a tertiary amine group is reacted with more than 2.2 molar equivalents of quaternising agent per mole of tertiary amine group present in the reaction product, for example from 2.3 to 4 molar equivalents, from 2.3 to 3 molar equivalents, or from 2.3 to 2.7 or from 2.5 to 3 molar equivalents.

To form some preferred quaternary ammonium salt additives of the present invention the compound of formula (I) is reacted with a compound formed by the reaction of a hydrocarbyl substituted acylating agent and an amine of formula (II) or (III).

The compounds of formula (II) or formula (III) are as described above.

Preferably the amine of formula (II) or (III) is reacted with a hydrocarbyl substituted succinic acid derived acylating agent such as a succinic acid or succinic anhydride.

Suitably approximately one equivalent of amine is added per succinic acid moiety present in the acylating agent. The ratio of amine used will thus typically depend on the average number of succinic acid moieties present in each molecule of the acylating agent.

Preferred quaternary ammonium salts for use herein may be formed by reacting methyl salicylate, dimethyl oxalate or propylene oxide optionally in combination with an acid with the reaction product of a polyisobutylene-substituted succinic anhydride having a PIB molecular weight (Mn) of 700 to 1300 and dimethylaminopropylamine. A mixture of two or more such quaternary ammonium salts may be used.

An especially preferred quaternary ammonium salt for use herein is formed by reacting methyl salicylate or dimethyl oxalate with the reaction product of a polyisobutylene-substituted succinic anhydride having a PIB molecular weight (Mn) of 700 to 1300 and dimethylaminopropylamine.

In one preferred embodiment the polyisobutylene-substituted succinic anhydride includes on average at least 1.2 succinic acid moieties per molecule.

In some preferred embodiments, the quaternary ammonium salt additive (a) is formed by reacting a quaternising agent with the reaction product of a polyisobutylene-substituted succinic anhydride having a PIB molecular weight (Mn) of 700 to 1300 and dimethylaminopropylamine, wherein the reaction product of the polyisobutylene-substituted succinic anhydride and the dimethylaminopropylamine is predominantly in the succinimide form. Preferably the quaternising agent is an alkylene oxide (preferably propylene oxide), optionally in combination with an acid, chloroacetic acid or a salt thereof, methyl salicylate or dimethyl oxalate. In some preferred embodiments, the quaternising agent is methyl salicylate.

In some preferred embodiments, the quaternary ammonium salt additive (a) is formed by reacting a quaternising agent with the reaction product of a polyisobutylene-substituted succinic anhydride having a PIB molecular weight (Mn) of 700 to 1300 and dimethylaminopropylamine, wherein the reaction product of the polyisobutylene-substituted succinic anhydride and the dimethylaminopropylamine is predominantly in the succinamide form. Preferably the quaternising agent is an alkylene oxide (preferably propylene oxide), optionally in combination with an acid, chloroacetic acid or a salt thereof, methyl salicylate or dimethyl oxalate. In some preferred embodiments, the quaternising agent is propylene oxide.

In some embodiments, the quaternary ammonium salt additive (a) is the reaction product of a quaternising agent and a compound including a tertiary amine group which is selected from (iv) simple alkylamines and alkanolamines.

In such embodiments, the compound including a tertiary amine group (iv) is a tertiary amine of formula $R^5R^6R^7N$, wherein each of $R^5$, $R^6$ and $R^7$ is independently an optionally substituted alkyl, alkenyl, aryl, alkaryl or aralkyl group.

The tertiary amine of formula $R^5R^6R^7N$ may be a small compound of low complexity and low molecular weight. In some embodiments the tertiary amine may be a complex molecule and/or a molecule of high molecular weight which includes a tertiary amine group.

The tertiary amine compounds of formula $R^5R^6R^7N$ preferably do not include any primary or secondary amine groups. In some embodiments they may be derived from compounds including these groups but preferably these have been subsequently reacted to form additional tertiary amine species. The tertiary amine compound of formula $R^5R^6R^7N$ may contain more than one tertiary amine group. However tertiary amine compounds including primary or secondary amine groups are within the scope of the invention provided these groups do not prevent quaternisation of the tertiary amine species.

In some embodiment of the compounds of formula $R^5R^6R^7N$, each of $R^5$, $R^6$ and $R^7$ is independently an optionally substituted alkyl, alkenyl, aryl, aralkyl or alkaryl group.

$R^5$, $R^6$ and $R^7$ may be the same or different. In some preferred embodiments $R^5$ and $R^6$ are the same and $R^7$ is different.

Preferably each of $R^5$ and $R^6$ is independently an optionally substituted alkyl, alkenyl, aryl, aralkyl or alkaryl group having from 1 to 50 carbon atoms, preferably from 1 to 40 carbon atoms, more preferably from 1 to 30 carbon atoms.

Each of $R^5$ and $R^6$ may be optionally substituted with one or more groups selected from halo (especially chloro and fluoro), hydroxy, alkoxy, keto, acyl, cyano, mercapto, alkylmercapto, dialkylamino, nitro, nitroso, and sulphoxy. The alkyl groups of these substituents may be further substituted.

Preferably each of $R^5$ and $R^6$ is independently an optionally substituted alkyl or alkenyl group. Preferably each of $R^5$ and $R^6$ is independently an optionally substituted alkyl group. In some embodiments each of $R^5$ and $R^6$ is independently an optionally substituted alkyl or alkenyl group having from 1 to 50 carbon atoms, preferably from 1 to 40 carbon atoms, more preferably from 1 to 30 carbon atoms, suitably from 1 to 20 carbon atoms, preferably from 1 to 12 carbon atoms, more preferably from 1 to 10 carbon atoms, suitably from 1 to 8 carbon atoms, for example from 1 to 6 carbon atoms.

In some preferred embodiments $R^5$ is an optionally substituted alkyl or alkenyl group, preferably having from 1 to 10, preferably from 1 to 4 carbon atoms. Preferably $R^5$ is an alkyl group. It may be a substituted alkyl group, for example a hydroxy substituted alkyl group. Preferably $R^5$ is an unsubstituted alkyl group. The alkyl chain may be straight-chained or branched. Preferably $R^5$ is selected from methyl, ethyl, propyl and butyl, including isomers thereof. Most preferably $R^5$ is methyl.

In some preferred embodiments $R^6$ is an optionally substituted alkyl or alkenyl group, preferably having from 1 to 10, preferably from 1 to 4 carbon atoms. Preferably $R^6$ is an alkyl group. It may be a substituted alkyl group, for example a hydroxy substituted alkyl group. Preferably $R^6$ is an unsubstituted alkyl group. The alkyl chain may be straight-chained or branched. Preferably $R^6$ is selected from methyl, ethyl, propyl and butyl, including isomers thereof. Most preferably $R^6$ is methyl.

In some embodiments $R^7$ is an optionally substituted alkyl or alkenyl group having from 1 to 50 carbon atoms, preferably from 1 to 40 carbon atoms, more preferably from 1 to 30 carbon atoms, suitably from 1 to 20 carbon atoms, preferably from 1 to 12 carbon atoms, more preferably from 1 to 10 carbon atoms, suitably from 1 to 8 carbon atoms, for example from 1 to 6 carbon atoms. Suitable substituents include halo (especially chloro and fluoro), hydroxy, alkoxy, keto, acyl, cyano, mercapto, alkylmercapto, amino, alkylamino, nitro, nitroso, sulphoxy, amido, alkyamido, imido and alkylimido. The alkyl groups of these substituents may be further substituted.

In some embodiments $R^7$ is an optionally substituted alkyl or alkenyl group, preferably having from 1 to 10, preferably from 1 to 4 carbon atoms. Suitably $R^7$ is an optionally substituted alkyl group. Preferably $R^7$ is a substituted alkyl group. Preferred substituents include alkoxy and hydroxyl groups.

In some preferred embodiments $R^7$ is a hydroxyl-substituted alkyl group. The alkyl chain may be straight-chained or branched. Most preferably $R^7$ is a hydroxyethyl group.

Suitable tertiary amine compounds of formula $R^5R^6R^7N$ include simple alkylamino and hydroxyalkylamino compounds; trialkylamino compounds having a high molecular weight substituent; Mannich reaction products including a tertiary amine and substituted acylated amines or alcohols including a tertiary amine.

Simple alkylamino and hydroxyalkyl amino compounds are preferably compounds of formula $R^5R^6R^7N$, wherein each of $R^5$, $R^6$ and $R^7$ is an alkyl group or a hydroxyalkyl group. Each of $R^5$, $R^6$ and $R^7$ may be the same or different. In some embodiments each of $R^5$, $R^6$ and $R^7$ is independently selected from an alkyl or hydroxyalkyl group having 1 to 10, preferably 1 to 6 carbon atoms, for example 1 to 4 carbon atoms. Each of $R^5$, $R^6$ and $R^7$ may be independently selected from methyl, ethyl, propyl, butyl, pentyl, hexyl, hydroxymethyl, hydroxyethyl, hydroxypropyl, hydroxybutyl, hydroxypentyl and hydroxyhexyl. The amine of formula $R^5R^6R^7N$ may be a trialkylamine, a dialkylhydroxyalkylamine, a dihydroxyalkylalkylamine or a trihydroxyalkylamine. There are many different compounds of this type and these will be known to the person skilled in the art.

In some embodiments one or two of the groups $R^5$, $R^6$ and $R^7$ is a short chain alkyl group having 1 to 6, preferably 1 to 4 carbon atoms and the other one or two groups is a longer chain alkyl or group having 6 to 30, preferably 10 to 24 carbon atoms.

In some embodiments each of $R^5$ and $R^6$ is $C_1$ to $C_4$ alkyl, preferably methyl and $R^7$ is an alkyl or alkenyl group having 6 to 36, preferably 10 to 30, for example 12 to 24 carbon atoms.

Compounds of this type include, for example, dimethyloctadecylamine and hexadecyl dimethyl amine.

In order to provide the quaternary ammonium salt additive, the hexadecyl dimethyl amine may be quaternised by reaction with propylene oxide (for example 1 to 3 molar equivalent of propylene oxide) and polyisobutylene succinic acid (for example 1 molar equivalent of polyisobutylene succinic acid).

For example in some embodiments $R^5$ is $C_1$ to $C_4$ alkyl, preferably methyl and each $R^6$ and $R^7$ is an alkyl or alkenyl having 6 to 36, preferably 8 to 30, for example 10 to 24 carbon atoms.

Compounds of this type include, for example, hexadecyl dimethyl amine, N-methyl N—N-ditallowamine and dicocomethyl amine.

Especially preferred tertiary amine compounds of formula $R^5R^6R^7N$ include N,N-dimethyl ethanolamine, dimethyloctadecylamine and N-methyl N—N-ditallowamine.

In some preferred embodiments, the quaternary ammonium salt additive (a) is the reaction product of a compound including a tertiary amine group and a quaternising agent, wherein the compound including a tertiary amine group is selected from one or more of:

(i-a) the reaction product of a fatty acid of formula RCOOH in which R is an alkyl or alkenyl group having 12 to 24 carbon atoms, and a compound of formula (II), wherein both $R^2$ and $R^3$ are $C_1$ to $C_4$ alkyl groups and X is alkylene group having from 2 to 5 carbon atoms;

(i-b) the reaction product of a hydrocarbyl substituted succinic acid derived acylating agent and a compound of formula (II), wherein both $R^2$ and $R^3$ are $C_1$ to $C_4$ alkyl groups and X is alkylene group having from 2 to 5 carbon atoms; and (iv-a) a tertiary amine of formula $R^5R^6R^7N$, wherein each of $R^5$, $R^6$ and $R^7$ is independently an alkyl group or a hydroxyalkyl group.

The quaternising agent is preferably selected from alkylene oxide (preferably propylene oxide), optionally in combination with an acid, chloroacetic acid or a salt thereof, methyl salicylate or dimethyl oxalate.

In some preferred embodiments, the quaternary ammonium salt additive (a) is the reaction product of a compound including a tertiary amine group and a quaternising agent, wherein the compound including a tertiary amine group is selected from one or more of:

(i-a) the reaction product of a fatty acid of formula RCOOH in which R is an alkyl or alkenyl group having 12 to 24 carbon atoms, and a compound selected from N,N-dimethyl-1,3-diaminopropane, N,N-diethyl-1,3-diaminopropane, N,N-dimethylethylenediamine, N,N-diethylethylenediamine, N,N-dibutylethylenediamine, 3-(2-(dimethylamino)ethoxy) propylamine, or combinations thereof;

(i-b) the reaction product of a hydrocarbyl substituted succinic acid derived acylating agent and a compound selected from N,N-dimethyl-1,3-diaminopropane, N,N-diethyl-1,3-diaminopropane, N,N-dimethylethylenediamine, N,N-diethylethylenediamine, N,N-dibutylethylenediamine, 3-(2-(dimethylamino)ethoxy) propylamine, or combinations thereof; and (iv-a) a tertiary amine of formula $R^5R^6R^7N$, wherein each of $R^5$, $R^6$ and $R^7$ is independently an alkyl group or a hydroxyalkyl group.

In some preferred embodiments, the quaternary ammonium salt additive (a) is the reaction product of a compound including a tertiary amine group and a quaternising agent;

wherein the quaternising agent is selected from alkylene oxide (preferably propylene oxide), optionally in combination with an acid, chloroacetic acid or a salt thereof, methyl salicylate or dimethyl oxalate;

wherein the compound including a tertiary amine group is selected from one or more of:

(i-a) the reaction product of a fatty acid of formula RCOOH in which R is an alkyl or alkenyl group having 12 to 24 carbon atoms, and a compound selected from N,N-dimethyl-1,3-diaminopropane, N,N-diethyl-1,3-diaminopropane, N,N-dimethylethylenediamine, N,N-diethylethylenediamine, N,N-dibutylethylenediamine, 3-(2-(dimethylamino)ethoxy) propylamine, or combinations thereof;

(i-b) the reaction product of a hydrocarbyl substituted succinic acid derived acylating agent and a compound selected from N,N-dimethyl-1,3-diaminopropane, N,N-diethyl-1,3-diaminopropane, N,N-dimethylethylenediamine, N,N-diethylethylenediamine, N,N-dibutylethylenediamine, 3-(2-(dimethylamino)ethoxy) propylamine, or combinations thereof; and (iv-a) a tertiary amine of formula $R^5R^6R^7N$, wherein each of $R^5$, $R^6$ and $R^7$ is independently an alkyl group or a hydroxyalkyl group.

In some especially preferred embodiments, the quaternary ammonium salt additive (a) is the reaction product of a compound including a tertiary amine group and a quaternising agent;

wherein the quaternising agent is selected from alkylene oxide (preferably propylene oxide), optionally in combination with an acid, chloroacetic acid or a salt thereof, methyl salicylate or dimethyl oxalate;

wherein the compound including a tertiary amine group is selected from one or more of:

(i-a) the reaction product of a fatty acid of formula RCOOH in which R is an alkyl or alkenyl group having 12 to 24 carbon atoms, and N,N-dimethyl-1,3-diaminopropane (DMAPA);

(i-b) the reaction product of a polyisobutylene-substituted succinic anhydride having a PIB molecular weight (Mn) of 700 to 1300 and N,N-dimethyl-1,3-diaminopropane; and (iv-a) a tertiary amine of formula $R^5R^6R^7N$, wherein each of $R^5$ and $R^6$ is $C_1$ to $C_4$ alkyl, preferably methyl, and $R^7$ is an alkyl or alkenyl group having 12 to 24 carbon atoms.

(b) the Reaction Product of a Carboxylic Acid-Derived Acylating Agent and an Amine In some embodiments the present invention involves the use as an additive of (b) the reaction product of a carboxylic acid-derived acylating agent and an amine.

These compounds may also be referred to herein in general as acylated nitrogen-containing compounds.

Suitable acylated nitrogen-containing compounds may be made by reacting a carboxylic acid acylating agent with an amine and are known to those skilled in the art.

Preferred hydrocarbyl substituted acylating agents are polyisobutenyl succinic anhydrides. These compounds are commonly referred to as "PIBSAs" and are known to the person skilled in the art.

Conventional polyisobutenes and so-called "highly-reactive" polyisobutenes are suitable for use in the invention. These are suitably as previously described herein in relation to the preparation of some preferred quaternary ammonium detergents.

Especially preferred PIBSAs are those having a PIB molecular weight (Mn) of from 300 to 2800, preferably from 450 to 2300, more preferably from 500 to 1300.

In preferred embodiments the reaction product of the carboxylic acid derived acylating agent and an amine includes at least one primary or secondary amine group.

A preferred acylated nitrogen-containing compound for use herein is prepared by reacting a poly(isobutene)-substituted succinic acid-derived acylating agent (e.g., anhydride, acid, ester, etc.) wherein the poly(isobutene) substituent has a number average molecular weight (Mn) of between 170 to 2800 with a mixture of ethylene polyamines having 2 to about 9 amino nitrogen atoms, preferably about 2 to about 8 nitrogen atoms, per ethylene polyamine and about 1 to about 8 ethylene groups. These acylated nitrogen compounds are suitably formed by the reaction of a molar ratio of acylating agent:amino compound of from 10:1 to 1:10, preferably from 5:1 to 1:5, more preferably from 2:1 to 1:2 and most preferably from 2:1 to 1:1. In especially preferred embodiments, the acylated nitrogen compounds are formed by the reaction of acylating agent to amino compound in a molar ratio of from 1.8:1 to 1:1.2, preferably from 1.6:1 to 1:1.2, more preferably from 1.4:1 to 1:1.1 and most preferably from 1.2:1 to 1:1. Acylated amino compounds of this type and their preparation are well known to those skilled in the art and are described in for example EP0565285 and U.S. Pat. No. 5,925,151.

In some preferred embodiments the composition comprises a detergent of the type formed by the reaction of a polyisobutene-substituted succinic acid-derived acylating agent and a polyethylene polyamine. Suitable compounds are, for example, described in WO2009/040583.

In a preferred embodiment the reaction product of a carboxylic acid-derived acylating agent and an amine (b) comprises the reaction product of a polyisobutene-substituted succinic acid or succinic anhydride and a polyethylene polyamine selected from ethylenediamine, diethylenetriamine, triethylenetetramine, tetraethylenepentamine, pentaethylenehexamine, hexaethylene-heptamine and mixtures and isomers thereof; wherein polyisobutene substituent has a number average molecular weight of between 500 and 2000, preferably between 600 and 1200.

(c) the Product of a Mannich Reaction Between an Aldehyde, an Amine and an Optionally Substituted Phenol In some embodiments the present invention may involve the use of (c) the product of a Mannich reaction between an aldehyde, an amine and an optionally substituted phenol.

Preferably component (c) comprises the product of a Mannich reaction between:

(x) an aldehyde;

(y) an amine; and (z) an optionally substituted phenol.

Preferably the aldehyde component used to prepare the Mannich additive is an aliphatic aldehyde. Preferably the aldehyde has 1 to 10 carbon atoms. Most preferably the aldehyde is formaldehyde.

Suitable amines for use in preparing the Mannich additive include monoamines and polyamines. One suitable monoamine is butylamine.

The amine used to prepare the Mannich additive is preferably a polyamine. This may be selected from any compound including two or more amine groups. Preferably the polyamine is a polyalkylene polyamine, preferably a polyethylene polyamine. Most preferably the polyamine comprises tetraethylenepentamine or ethylenediamine.

The optionally substituted phenol component used to prepare the Mannich additive may be substituted with 0 to 4 groups on the aromatic ring (in addition to the phenol OH). For example it may be a hydrocarbyl-substituted cresol. Most preferably the phenol component is a mono-substituted phenol. Preferably it is a hydrocarbyl substituted phenol. Preferred hydrocarbyl substituents are alkyl substituents having 4 to 28 carbon atoms, especially 10 to 14 carbon atoms. Other preferred hydrocarbyl substituents are polyalkenyl substituents. Such polyisobutenyl substituents having a number average molecular weight of from 400 to 2500, for example from 500 to 1500.

Preferred Mannich reaction products used in the present invention are typically formed by reacting components (x), (y) and (z) in a molar ratio of 1.1 to 5 parts (x) to 1 part (y) to 1.1 to 2 parts (z).

Suitable Mannich reaction products and methods of preparing such additives will be known to the person skilled in the art and include the compounds described, for example, in the applicant's publications WO2009040582 and WO2013017887.

Preferred Mannich reaction product additives are the reaction product of formaldehyde, polyethylene polyamine; and a para-substituted monoalkyl phenol.

An especially preferred Mannich reaction product additive for use herein is the reaction product of dodecyl phenol, formaldehyde and ethylene diamine.

Suitable treat rates of the one or more nitrogen-containing detergents may depend on the type of fuel used and different levels of additive may be needed to achieve different levels of performance.

In preferred embodiments the diesel fuel composition comprises one or more of:

(a) a quaternary ammonium salt additive;

(b) the reaction product of a carboxylic acid-derived acylating agent and an amine; and (c) the product of a Mannich reaction between an aldehyde, an amine and an optionally substituted phenol.

In some embodiments the diesel fuel composition comprises from 0.1 to 10000 ppm, preferably from 1 to 1000 ppm, preferably from 5 to 250 ppm, for example 5 to 100 ppm of (a) a quaternary ammonium salt additive.

In some embodiments the diesel fuel composition comprises from 0.1 to 10000 ppm, preferably from 1 to 1000 ppm, preferably from 5 to 500 ppm, for example 5 to 250 ppm of (b) the reaction product of a carboxylic acid-derived acylating agent and an amine.

In some embodiments the diesel fuel composition comprises from 0.1 to 10000 ppm, preferably from 1 to 1000 ppm, preferably from 5 to 500 ppm, for example 5 to 100 ppm of (c) the product of a Mannich reaction between an aldehyde, an amine and an optionally substituted phenol.

Each of additives (a), (b) and (c) may be provided as a mixture of compounds. The above amounts refer to the total of all such compounds present in the composition.

For the avoidance of doubt the above amounts refer to the amount of active additive compound present in the composition and ignore any impurities, solvents or diluents which may be present.

In some embodiments the diesel fuel composition comprises (a) a quaternary ammonium salt additive and (b) the reaction product of a carboxylic acid-derived acylating agent and an amine.

In some embodiments the diesel fuel composition comprises (a) a quaternary ammonium salt additive and (c) the product of a Mannich reaction between an aldehyde, an amine and an optionally substituted phenol.

In some embodiments the diesel fuel composition comprises (b) the reaction product of a carboxylic acid-derived acylating agent and an amine and (c) the product of a Mannich reaction between an aldehyde, an amine and an optionally substituted phenol.

In some embodiments the diesel fuel composition comprises (a) a quaternary ammonium salt additive, (b) the reaction product of a carboxylic acid-derived acylating agent and an amine and (c) the product of a Mannich reaction between an aldehyde, an amine and an optionally substituted phenol.

In some embodiments the diesel fuel composition comprises (b) the reaction product of a carboxylic acid-derived acylating agent and an amine and (c) the product of a Mannich reaction between an aldehyde, an amine and an optionally substituted phenol; wherein component (b) comprises the reaction product of a polyisobutene-substituted succinic acid or succinic anhydride and a polyethylene polyamine selected from ethylenediamine, diethylenetriamine, triethylenetetramine, tetraethylenepentamine, pentaethylenehexamine, hexaethylene-heptamine and mixtures and isomers thereof; wherein polyisobutene substituent has a number average molecular weight of between 500 and 2000, preferably between 600 and 1200; and component (c) comprises the reaction product of formaldehyde, a polyethylene polyamine and a para-substituted monoalkyl phenol, preferably dodecyl phenol.

In some embodiments the diesel fuel composition comprises (a) a quaternary ammonium salt additive and (c) the product of a Mannich reaction between an aldehyde, an amine and an optionally substituted phenol, suitably wherein (a) and (c) are present in a weight ratio of from 1:2 to 1:4, preferably around 1:3; wherein component (a) comprises a quaternary ammonium salt formed by reacting methyl salicylate, dimethyl oxalate or propylene oxide (optionally in combination with an acid) with the reaction product of a polyisobutylene-substituted succinic anhydride having a PIB molecular weight (Mn) of 700 to 1300 and dimethylaminopropylamine; and component (c) comprises the reaction product of formaldehyde, a polyethylene polyamine and a para-substituted monoalkyl phenol, preferably dodecyl phenol.

In some embodiments the diesel fuel composition comprises (a) a quaternary ammonium salt additive, (b) the reaction product of a carboxylic acid-derived acylating agent and an amine and (c) the product of a Mannich reaction between an aldehyde, an amine and an optionally substituted phenol; wherein component (a) comprises a quaternary ammonium salt formed by reacting methyl salicylate, dimethyl oxalate or propylene oxide (optionally in combination with an acid) with the reaction product of a polyisobutylene-substituted succinic anhydride having a PIB molecular weight (Mn) of 700 to 1300 and dimethylaminopropylamine; component (b) comprises the reaction product of a polyisobutene-substituted succinic acid or succinic anhydride and a polyethylene polyamine selected from ethylenediamine, diethylenetriamine, triethylenetetramine, tetraethylenepentamine, pentaethylenehexamine, hexaethylene-heptamine and mixtures and isomers thereof; wherein polyisobutene substituent has a number average molecular weight of between 500 and 2000, preferably between 600 and 1200; and component (c) comprises the reaction product of formaldehyde, a polyethylene polyamine and a para-substituted monoalkyl phenol, preferably dodecyl phenol.

In some embodiments the diesel fuel composition comprises (a) a quaternary ammonium salt additive and (c) the product of a Mannich reaction between an aldehyde, an amine and an optionally substituted phenol, suitably wherein (a) and (c) are present in a weight ratio of from 1:2 to 1:4, preferably around 1:3; wherein component (a) comprises a quaternary ammonium salt formed by the reaction of a compound including a tertiary amine group and a quaternising agent;

wherein the quaternising agent is selected from alkylene oxide (preferably propylene oxide), optionally in combination with an acid, chloroacetic acid or a salt thereof, methyl salicylate or dimethyl oxalate;

wherein the compound including a tertiary amine group is selected from:

(i-a) the reaction product of a fatty acid of formula RCOOH in which R is an alkyl or alkenyl group having 12 to 24 carbon atoms, and N,N-dimethyl-1,3-diaminopropane (DMAPA);

(i-b) the reaction product of a polyisobutylene-substituted succinic anhydride having a PIB molecular weight (Mn) of 700 to 1300 and N,N-dimethyl-1,3-diaminopropane; and (iv-a) a tertiary amine of formula $R^5R^6R^7N$, wherein each of $R^5$ and $R^6$ is $C_1$ to $C_4$ alkyl, preferably methyl, and $R^7$ is an alkyl or alkenyl group having 12 to 24 carbon atoms; and component (c) comprises the reaction product of formaldehyde, a polyethylene polyamine and a para-substituted monoalkyl phenol, preferably dodecyl phenol.

In some embodiments the diesel fuel composition comprises (a) a quaternary ammonium salt additive, (b) the reaction product of a carboxylic acid-derived acylating agent and an amine and (c) the product of a Mannich reaction between an aldehyde, an amine and an optionally substituted phenol; wherein component (a) comprises a quaternary ammonium salt formed by the reaction of a compound including a tertiary amine group and a quaternising agent;

wherein the quaternising agent is selected from alkylene oxide (preferably propylene oxide), optionally in combination with an acid, chloroacetic acid or a salt thereof, methyl salicylate or dimethyl oxalate;

wherein the compound including a tertiary amine group is selected from:

(i-a) the reaction product of a fatty acid of formula RCOOH in which R is an alkyl or alkenyl group having 12 to 24 carbon atoms, and N,N-dimethyl-1,3-diaminopropane (DMAPA);

(i-b) the reaction product of a polyisobutylene-substituted succinic anhydride having a PIB molecular weight (Mn) of 700 to 1300 and N,N-dimethyl-1,3-diaminopropane; and (iv-a) a tertiary amine of formula $R^5R^6R^7N$, wherein each of $R^5$ and $R^6$ is $C_1$ to $C_4$ alkyl, preferably methyl, and $R^7$ is an alkyl or alkenyl group having 12 to 24 carbon atoms;

component (b) comprises the reaction product of a polyisobutene-substituted succinic acid or succinic anhydride and a polyethylene polyamine selected from ethylenediamine, diethylenetriamine, triethylenetetramine, tetraethylenepentamine, pentaethylenehexamine, hexaethylene-heptamine and mixtures and isomers thereof; wherein polyisobutene substituent has a number average molecular weight of between 500 and 2000, preferably between 600 and 1200; and component (c) comprises the reaction product of formaldehyde, a polyethylene polyamine and a para-substituted monoalkyl phenol, preferably dodecyl phenol.

In some embodiments the diesel fuel composition comprises (a) a quaternary ammonium salt additive and (c) the product of a Mannich reaction between an aldehyde, an amine and an optionally substituted phenol, suitably wherein (a) and (c) are present in a weight ratio of from 1:2 to 1:4, preferably around 1:3; wherein component (a) comprises a quaternary ammonium salt formed by the reaction of a compound including a tertiary amine group and a quaternising agent;

wherein the quaternising agent is selected from alkylene oxide (preferably propylene oxide), optionally in combination with an acid, chloroacetic acid or a salt thereof, methyl salicylate or dimethyl oxalate;

wherein the compound including a tertiary amine group is (i-a) the reaction product of a fatty acid of formula RCOOH in which R is an alkyl or alkenyl group having 12 to 24 carbon atoms, and N,N-dimethyl-1,3-diaminopropane (DMAPA); and component (c) comprises the reaction product of formaldehyde, a polyethylene polyamine and a para-substituted monoalkyl phenol, preferably dodecyl phenol.

In some embodiments the diesel fuel composition comprises (a) a quaternary ammonium salt additive, (b) the reaction product of a carboxylic acid-derived acylating agent and an amine and (c) the product of a Mannich reaction between an aldehyde, an amine and an optionally substituted phenol; wherein component (a) comprises a quaternary ammonium salt formed by the reaction of a compound including a tertiary amine group and a quaternising agent;

wherein the quaternising agent is selected from alkylene oxide (preferably propylene oxide), optionally in combination with an acid, chloroacetic acid or a salt thereof, methyl salicylate or dimethyl oxalate;

wherein the compound including a tertiary amine group is (i-a) the reaction product of a fatty acid of formula RCOOH in which R is an alkyl or alkenyl group having 12 to 24 carbon atoms, and N,N-dimethyl-1,3-diaminopropane (DMAPA);

component (b) comprises the reaction product of a polyisobutene-substituted succinic acid or succinic anhydride and a polyethylene polyamine selected from ethylenediamine, diethylenetriamine, triethylenetetramine, tetraethylenepentamine, pentaethylenehexamine, hexaethylene-heptamine and mixtures and isomers thereof; wherein polyisobutene substituent has a number average molecular weight of between 500 and 2000, preferably between 600 and 1200; and component (c) comprises the reaction product of formaldehyde, a polyethylene polyamine and a para-substituted monoalkyl phenol, preferably dodecyl phenol.

In some embodiments the diesel fuel composition comprises (a) a quaternary ammonium salt additive and (c) the product of a Mannich reaction between an aldehyde, an amine and an optionally substituted phenol, suitably wherein (a) and (c) are present in a weight ratio of from 1:2 to 1:4, preferably around 1:3; wherein component (a) comprises a quaternary ammonium salt formed by the reaction of a compound including a tertiary amine group and a quaternising agent;

wherein the quaternising agent is selected from alkylene oxide (preferably propylene oxide), optionally in combination with an acid, chloroacetic acid or a salt thereof, methyl salicylate or dimethyl oxalate;

wherein the compound including a tertiary amine group is (iv-a) a tertiary amine of formula $R^5R^6R^7N$, wherein each of $R^5$ and $R^6$ is $C_1$ to $C_4$ alkyl, preferably methyl, and $R^7$ is an alkyl or alkenyl group having 12 to 24 carbon atoms; and component (c) comprises the reaction product of formaldehyde, a polyethylene polyamine and a para-substituted monoalkyl phenol, preferably dodecyl phenol.

In some embodiments the diesel fuel composition comprises (a) a quaternary ammonium salt additive, (b) the reaction product of a carboxylic acid-derived acylating agent and an amine and (c) the product of a Mannich reaction between an aldehyde, an amine and an optionally substituted phenol; wherein component (a) comprises a quaternary ammonium salt formed by the reaction of a compound including a tertiary amine group and a quaternising agent;

wherein the quaternising agent is selected from alkylene oxide (preferably propylene oxide), optionally in combination with an acid, chloroacetic acid or a salt thereof, methyl salicylate or dimethyl oxalate;

wherein the compound including a tertiary amine group is (iv-a) a tertiary amine of formula $R^5R^6R^7N$, wherein each of $R^5$ and $R^6$ is $C_1$ to $C_4$ alkyl, preferably methyl, and $R^7$ is an alkyl or alkenyl group having 12 to 24 carbon atoms;

component (b) comprises the reaction product of a polyisobutene-substituted succinic acid or succinic anhydride and a polyethylene polyamine selected from ethylenediamine, diethylenetriamine, triethylenetetramine, tetraethylenepentamine, pentaethylenehexamine, hexaethylene-heptamine and mixtures and isomers thereof; wherein polyisobutene substituent has a number average molecular weight of between 500 and 2000, preferably between 600 and 1200; and component (c) comprises the reaction product of formaldehyde, a polyethylene polyamine and a para-substituted monoalkyl phenol, preferably dodecyl phenol.

The one or more nitrogen containing detergents may be added to diesel fuel at any convenient place in the supply chain. For example, the additive may be added to fuel at the refinery, at a distribution terminal or after the fuel has left the distribution terminal. If the additive is added to the fuel after it has left the distribution terminal, this is termed an aftermarket application. Aftermarket applications include such circumstances as adding the additive to the fuel in the delivery tanker, directly to a customer's bulk storage tank, or directly to the end user's vehicle tank. Aftermarket applications may include supplying the fuel additive in small bottles suitable for direct addition to fuel storage tanks or vehicle tanks.

By diesel fuel we include any fuel suitable for use in a diesel engine either for road use or non-road use. This includes but is not limited to fuels described as diesel, marine diesel, heavy fuel oil, industrial fuel oil, etc.

The diesel fuel composition used in the present invention may comprise a petroleum-based fuel oil, especially a middle distillate fuel oil. Such distillate fuel oils generally boil within the range of from 110° C. to 500° C., e.g. 150° C. to 400° C. The diesel fuel may comprise atmospheric distillate or vacuum distillate, cracked gas oil, or a blend in any proportion of straight run and refinery streams such as thermally and/or catalytically cracked and hydro-cracked distillates.

The diesel fuel composition may comprise non-renewable Fischer-Tropsch fuels such as those described as GTL (gas-to-liquid) fuels, CTL (coal-to-liquid) fuels and OTL (oil sands-to-liquid).

The diesel fuel composition may comprise a renewable fuel such as a biofuel composition or biodiesel composition.

The diesel fuel composition may comprise first generation biodiesel. First generation biodiesel contains esters of, for example, vegetable oils, animal fats and used cooking fats or oils. This form of biodiesel may be obtained by transesterification of oils, for example rapeseed oil, soybean oil, canola oil, safflower oil, palm oil, corn oil, peanut oil, cotton seed oil, tallow, coconut oil, physic nut oil (Jatropha), sunflower seed oil, used cooking oils, hydrogenated vegetable oils or any mixture thereof, with an alcohol, usually a monoalcohol, usually in the presence of a catalyst.

The diesel fuel composition may comprise second generation biodiesel. Second generation biodiesel is derived from renewable resources such as vegetable oils and animal fats and processed, often in the refinery, using, for example, hydroprocessing such as the H-Bio process developed by Petrobras. Second generation biodiesel may be similar in properties and quality to petroleum based fuel oil streams, for example renewable diesel produced from vegetable oils, animal fats etc. and marketed by ConocoPhillips as Renewable Diesel and by Neste as NExBTL.

The diesel fuel composition may comprise third generation biodiesel. Third generation biodiesel utilises gasification and Fischer-Tropsch technology including those described as BTL (biomass-to-liquid) fuels. Third generation biodiesel does not differ widely from some second generation biodiesel, but aims to exploit the whole plant (biomass) and thereby widens the feedstock base.

In some embodiments the diesel fuel composition may comprise a pyrolysis oil, for example a plastic pyrolysis oil or a biomass (wood, vegetable oil, algae) pyrolysis oil.

The diesel fuel composition may contain blends of any or all of the above diesel fuel compositions.

In some embodiments the diesel fuel composition may be a blended diesel fuel comprising bio-diesel. In such blends the bio-diesel may be present in an amount of, for example up to 0.5%, up to 1%, up to 2%, up to 3%, up to 4%, up to 5%, up to 10%, up to 20%, up to 30%, up to 40%, up to 50%, up to 60%, up to 70%, up to 80%, up to 90%, up to 95% or up to 99%.

In some embodiments the fuel composition may comprise neat biodiesel.

In some preferred embodiments the fuel composition comprises at least 5 wt % biodiesel.

In some embodiments the fuel composition may comprise GTL fuel or be a neat GTL fuel.

In some embodiments the diesel fuel composition may comprise a secondary fuel, for example ethanol. Preferably however the diesel fuel composition does not contain ethanol.

The diesel fuel composition used in the present invention may contain a relatively high sulphur content, for example greater than 0.05% by weight, such as 0.1% or 0.2%.

However, in preferred embodiments the diesel fuel composition has a sulphur content of at most 0.05% by weight, more preferably of at most 0.035% by weight, especially of at most 0.015%. Fuels with even lower levels of sulphur are also suitable such as, fuels with less than 50 ppm sulphur by weight, preferably less than 20 ppm, for example 10 ppm or less.

The diesel fuel composition used in the present invention preferably comprises at least 5 wt % biodiesel and less than 50 ppm sulphur.

Various metal species may be present in the diesel fuel composition. This may be due to contamination of the fuel during manufacture, storage, transport or use or due to contamination of fuel additives. Metal species may also be added to fuels deliberately. For example, transition metals are sometimes added as fuel borne catalysts, for example to improve the performance of diesel particulate filters.

Other metal-containing species may also be present as a contaminant, for example through the corrosion of metal and metal oxide surfaces by acidic species present in the fuel or from lubricating oil. In use, fuels such as diesel fuels routinely come into contact with metal surfaces for example, in vehicle fueling systems, fuel tanks, fuel transportation means etc. Typically, metal-containing contamination may comprise transition metals such as zinc, iron and copper; Group I or Group II metals and other metals such as lead.

In addition to metal-containing contamination which may be present in diesel fuels there are circumstances where metal-containing species may deliberately be added to the fuel. For example, as is known in the art, metal-containing fuel-borne catalyst species may be added to aid with the regeneration of particulate traps. The presence of such catalysts may also give rise to injector deposits when the fuels are used in diesel engines having high pressure fuel systems.

Metal-containing contamination, depending on its source, may be in the form of insoluble particulates or soluble compounds or complexes. Metal-containing fuel-borne catalysts are often soluble compounds or complexes or colloidal species.

In some embodiments, the diesel fuel may comprise metal-containing species comprising a fuel-borne catalyst. Preferably, the fuel borne catalyst comprises one or more metals selected from iron, cerium, platinum, manganese, Group I and Group 11 metals e.g., calcium and strontium. Most preferably the fuel borne catalyst comprises a metal selected from iron and cerium.

Typically, the total amount of all metal-containing species in the diesel fuel, expressed in terms of the total weight of metal in the species, is between 0.1 and 50 ppm by weight, for example between 0.1 and 20 ppm, preferably between 0.1 and 10 ppm by weight, based on the weight of the diesel fuel.

The diesel fuel compositions used in the present invention may include one or more further additives such as those which are commonly found in diesel fuels. These include, for example, antioxidants, dispersants, detergents, metal deactivating compounds, wax anti-settling agents, cold flow improvers, cetane improvers, dehazers, stabilisers, demulsifiers, antifoams, corrosion inhibitors, lubricity improvers, dyes, markers, combustion improvers, metal deactivators, odour masks, drag reducers and conductivity improvers. Examples of suitable amounts of each of these types of additives will be known to the person skilled in the art.

Suitable cetane number improvers may be selected from C2-24 alkyl nitrates and dialkyl peroxides, preferably decyl nitrate, 2-ethylhexyl nitrate and di-tert-butyl peroxides. Such cetane number improvers are suitably used at a concentration of 50-6,000 ppm, preferably at 50-750 ppm based on the diesel fuel composition.

The present invention reduces the impact of deposits in the EGR system and/or the post combustion system of a diesel engine.

The diesel engine may be a direct injection diesel engine or an indirect injection diesel engine.

In some embodiments the engine may be an off road engine, for example a marine, rail or stationary engine. Stationary engines include engines for power generation and pumping.

Most preferably the engine is a direct injection diesel engine.

The post combustion deposit control additives used in the present invention have been found to be particularly effective in modern diesel engines having a high pressure fuel system.

Suitably the present invention may be used to reduce the formation or deposits in the post combustion system of a diesel engine having a high pressure fuel system. Suitably the diesel engine has a fuel pressure in excess of 1350 bar ($1.35\times10^8$ Pa). It may have a pressure of up to 2000 bar ($2\times10^8$ Pa) or more.

Such diesel engines may be characterised in a number of ways.

Such engines are typically equipped with fuel injection equipment meeting or exceeding "Euro 5" emissions legislation or equivalent legislation in the US or other countries.

Such engines are typically equipped with fuel injectors having a plurality of apertures, each aperture having an inlet and an outlet.

Such engines may be characterised by apertures which are tapered such that the inlet diameter of the spray-holes is greater than the outlet diameter.

Such modern engines may be characterised by apertures having an outlet diameter of less than 500 μm, preferably less than 200 μm, more preferably less than 150 μm, preferably less than 100 μm, most preferably less than 80 μm or less.

Such modern diesel engines may be characterised by apertures where an inner edge of the inlet is rounded.

Such modern diesel engines may be characterised by the injector having more than one aperture, suitably more than 2 apertures, preferably more than 4 apertures, for example 6 or more apertures.

Such modern diesel engines may be characterised by an operating tip temperature in excess of 250° C.

Such modern diesel engines may be characterised by a fuel injection system which provides a fuel pressure of more than 1350 bar, preferably more than 1500 bar, more preferably more than 2000 bar.

Two non-limiting examples of such high pressure fuel systems are: the common rail injection system, in which the fuel is compressed utilizing a high-pressure pump that supplies it to the fuel injection valves through a common rail; and the unit injection system which integrates the high-pressure pump and fuel injection valve in one assembly, achieving the highest possible injection pressures exceeding 2000 bar ($2\times10^8$ Pa). In both systems, in pressurising the fuel, the fuel gets hot, often to temperatures around 100° C., or above.

Preferably, the diesel engine has fuel injection system which comprises a common rail injection system.

In common rail systems, the fuel is stored at high pressure in the central accumulator rail or separate accumulators prior to being delivered to the injectors. Often, some of the heated fuel is returned to the low pressure side of the fuel system or returned to the fuel tank. In unit injection systems the fuel is compressed within the injector in order to generate the high injection pressures. This in turn increases the temperature of the fuel.

In both systems, fuel is present in the injector body prior to injection where it is heated further due to heat from the combustion chamber. The temperature of the fuel at the tip of the injector can be as high as 250-350° C.

Thus the fuel is stressed at pressures from 1350 bar ($1.35\times10^8$ Pa) to over 2000 bar ($2\times10^8$ Pa) and temperatures from around 100° C. to 350° C. prior to injection, sometimes being recirculated back within the fuel system thus increasing the time for which the fuel experiences these conditions.

The EGR system recirculates the exhaust gases to lower the oxygen concentration in the combustion chamber. This reduces the generation of NOx gases.

The EGR system includes a cooler. This component lowers the temperature of the recirculated exhaust gases.

Exhaust gases enter the EGR system after they pass through or are generated within the combustion chamber. The exhaust gases may contain materials resulting from incomplete combustion. These materials may deposit within the EGR system. One component where deposit build up frequently occurs is in the cooler of the EGR system.

Previously these deposits have not been studied in the same level of detail as other fuel system or combustion deposits. Indeed the finding of such deposits appears to be a relatively recent phenomenon. Particularly strong reviews of the work done to elucidate how they may form and why they are a problem can be found in Lance et al International Journal of Heat and Mass Transfer 126, (2018), 509-520 and SAE 2014-01-0629.

The present inventors have studied the nature of the deposits found in the EGR system and in particular within the cooler. It has been surprisingly found that the formation of these deposits in particular can be reduced by the addition of one or more nitrogen containing detergents into the diesel fuel combusted in the engine.

The use of the first aspect and/or the method of the second aspect may involve reducing the impact of deposits in the exhaust gas recirculation system of a diesel engine which is a high pressure, low pressure, hybrid or dedicated EGR system. Suitably the exhaust gas recirculation system is a high pressure, hybrid or dedicated EGR system. Preferably the exhaust gas recirculation system is a high pressure or hybrid EGR system. Most preferably, the exhaust gas recirculation system is a high pressure EGR system.

Preferably the use or method of the present invention reduces the formation of deposits in a high pressure EGR system of a diesel engine.

By reducing the formation of deposits in an EGR system we mean that when a fuel comprising the EGR deposit reducing additive is combusted in an engine, a reduced level of deposits is obtained compared to when an otherwise identical fuel is combusted under identical conditions except for the inclusion of the EGR deposit reducing additive.

Suitably addition of one or more nitrogen containing detergents into the diesel fuel combusted in an engine reduces the formation of deposits in an EGR system by at least 5%, preferably by at least 10%, for example at least 15% or at least 20%.

In some embodiments the addition of one or more nitrogen containing detergents into the diesel fuel combusted in an engine may reduce the formation of deposits in an EGR system by at least 30%, for example at least 40% or at least 50%.

Suitably addition of one or more nitrogen containing detergents into the diesel fuel combusted in an engine reduces the formation of deposits in the cooler an EGR system by at least 5%, preferably by at least 10%, for example at least 15% or at least 20%.

In some embodiments the addition of one or more nitrogen containing detergents into the diesel fuel combusted in an engine may reduce the formation of deposits in the cooler of an EGR system by at least 30%, for example at least 40% or at least 50%.

The reduction in deposits in an EGR system may be measured by any suitable means.

One simple means by which the level of deposits in an EGR system may be determined is by weighing the system before and after use. One or more parts of the system may be weighed.

Preferably the present invention reduces the total amount of deposits formed in an EGR system by at least 5%, preferably at least 10%, more preferably at least 15%, for example at least 20% or at least 30%.

Suitably the present invention reduces the total amount of deposits formed within the cooler of an EGR system.

Preferably the present invention reduces the total amount of deposits formed within the cooler of an EGR system by at least 5%, preferably at least 10%, more preferably at least 15%, for example at least 20% or at least 30%.

The deposits that form in the EGR system may be analysed. This may be achieved, for example by extracting the deposits or a portion thereof into a solvent. The sample may be separated into soluble and non soluble fractions; these may then be separately analysed by methods known to those skilled in the art, for example elemental analysis, thermogravimetric analysis and/or gas chromatography mass spectrometry.

The deposits that form in the EGR system may be analysed for example by thermogravimetric analysis (TGA). A significant proportion of the deposits that occur on the cooler of an EGR system were found to be carbonaceous deposits that degrade at temperatures of between 400 to 540° C. when subjected to thermogravimetric analysis (TGA).

Thermogravimetric analysis (or TGA) involves measuring the mass of a sample over time as it is heated. This technique is well known to the person skilled in the art and the selection of an appropriate method and suitable equipment will be within the competence of one skilled in the art.

The post combustion system of diesel engines is provided to reduce the emission of pollutants such as particulates and harmful gases into the environment. The formation of deposits on parts of the post combustion system can reduce the efficiency of the system and lead to an increase in the emission of particulate deposits and/or harmful gases.

In some embodiments the impact of the deposits may be reduced by a change in the nature of deposits.

Preferably the present invention reduces the formation of deposits in the post combustion system.

By reducing the formation of deposits in a post combustion system we mean that when a fuel comprising one or more nitrogen containing detergents is combusted in an engine, a reduced level of deposits is obtained compared to when an otherwise identical fuel is combusted under identical conditions except for the inclusion of the post combustion deposit reducing additive.

Suitably addition one or more nitrogen containing detergents into the diesel fuel combusted in an engine reduces the formation of deposits in one or more components of the post combustion system by at least 0.01%, preferably by at least 0.1%, for example at least 1% or at least 2%.

In some embodiments the addition of one or more nitrogen containing detergents into the diesel fuel combusted in an engine may reduce the formation of deposits in one or more components of the post combustion system by at least 3%, for example at least 4% or at least 5%.

By the post combustion system of a diesel engine we mean to refer to any part of the engine through which exhaust gases pass after finally leaving the combustion system.

The post combustion system may comprise one or more components selected from a turbocharger, a diesel oxidation catalyst, a diesel particulate filter, a selective catalytic reduction unit and an ammonia oxidation unit. The post combustion system may include these components in any order and this may order vary from vehicle to vehicle. The present invention may reduce the impact of deposits in or on one or more of these components.

In some embodiments addition of one or more nitrogen containing detergents into the diesel fuel combusted in an engine reduces the formation of deposits in the turbocharger, suitably by at least 0.01%, preferably by at least 0.1%, for example at least 1% or at least 2%.

The present invention may reduce deposits on a fixed geometry turbocharger or on a variable geometry turbocharger. Variable geometry turbochargers having moving parts which are controlled by the engine management system. This allows the aspect ratio of the turbocharger to be changed to optimise performance at different speeds. The formation of deposits can lead to parts sticking. As a result the turbocharger will not provide the correct level of boost and may ultimately fail. The reduction of deposits on the turbocharger is therefore highly beneficial.

Preferably the present invention reduces deposits on the turbine wheel of the turbocharger.

In some embodiments the addition of a nitrogen containing detergent into the diesel fuel combusted in an engine may reduce the formation of deposits in the turbocharger by at least 3%, for example at least 4% or at least 5%.

In some embodiments addition of one or more nitrogen containing detergents into the diesel fuel combusted in an engine reduces the formation of deposits in the diesel oxidation catalyst, suitably by at least 0.01%, preferably by at least 0.1%, for example at least 1% or at least 2%.

The diesel oxidation catalyst typically comprises a ceramic support structure coated with metals such as palladium, platinum and/or rhodium. The formation of deposits in the diesel oxidation catalyst can lead to a reduction in flow rate through the catalyst and/or poisoning of the catalyst.

In some embodiments the addition of one or more nitrogen containing detergents into the diesel fuel combusted in an engine may reduce the formation of deposits in the diesel oxidation catalyst by at least 3%, for example at least 4% or at least 5%.

Suitably addition of one or more nitrogen containing detergents into the diesel fuel combusted in an engine reduces the formation of deposits in the diesel particulate filter, suitably by at least 0.01%, preferably by at least 0.1%, for example at least 1% or at least 2%.

Suitably addition of one or more nitrogen containing detergents into the diesel fuel combusted in an engine reduces the accumulation of soot in the diesel particulate filter, suitably by at least 0.01%, preferably by at least 0.1%, for example at least 1% or at least 2%.

The diesel particulate filter is designed to capture from the exhaust gases particulates such as soot which are formed in the combustion chamber. These particulates collect on the filter and are burnt off at intervals by the increasing temperature of the exhaust gases and the injection of additional fuel. This process is known as filter regeneration.

The present invention may increase the interval between regenerations. This can improve the fuel economy of the engine and reduce emissions. By a reduction in regenerations we mean to include a reduction in active, passive or parked regenerations of the diesel particulate filter. For example there may be a reduction in the number of regeneration events per 1000 km.

In some embodiments the addition of one or more nitrogen containing detergents into the diesel fuel combusted in an engine may reduce the formation of deposits in the diesel particulate filter by at least 3%, for example at least 4% or at least 5%.

In some embodiments addition of one or more nitrogen containing detergents into the diesel fuel combusted in an engine reduces the formation of deposits in the selective catalytic reduction unit, suitably by at least 0.01%, preferably by at least 0.1%, for example at least 1% or at least 2%.

Selective catalytic reduction is used to remove NOx and other harmful gases from the exhaust stream and involves the use of ammonia as a reductant in the presence of a catalyst. The selective catalytic reduction unit comprises a porous ceramic support and a catalyst, typically comprising a metal or a zeolite.

The formation of deposits on the selective catalytic reduction unit can lead to a reduction in flow rate through the unit and/or poisoning of the catalyst.

In some embodiments the addition of a nitrogen containing detergent into the diesel fuel combusted in an engine may reduce the formation of deposits in the selective catalytic reduction unit by at least 3%, for example at least 4% or at least 5%.

In some embodiments addition of one or more nitrogen containing detergents into the diesel fuel combusted in an engine reduces the formation of deposits in the ammonia oxidation catalyst, suitably by at least 0.01%, preferably by at least 0.1%, for example at least 1% or at least 2%.

The ammonia oxidation catalyst is used to oxidise any ammonia present in the exhaust gases after passing through the selective catalytic reduction unit.

The formation of deposits on the ammonia oxidation catalyst can lead to a reduction in flow rate through the catalyst and/or poisoning of the catalyst.

In some embodiments the addition of one or more nitrogen containing detergents into the diesel fuel combusted in an engine may reduce the formation of deposits in the ammonia oxidation catalyst by at least 3%, for example at least 4% or at least 5%.

In some embodiments addition of one or more nitrogen containing detergents into the diesel fuel combusted in an engine reduces the formation of deposits on sensors within the post combustion system, suitably by at least 0.01%, preferably by at least 0.1%, for example at least 1% or at least 2%.

Sensors may be present in the post combustion to measure temperature, pressure and/or concentrations of gases such as NOx in the exhaust gases. If deposits are present on or around the sensors they may be unable to function correctly or inaccurate measurements may be taken leading to incorrect information being provided to the engine management system. This can lead to poor performance of the engine.

In some embodiments the addition of one or more nitrogen containing detergents into the diesel fuel combusted in an engine may reduce the formation of deposits on sensors within the post combustion system by at least 3%, for example at least 4% or at least 5%.

The reduction in deposits in post combustion system may be measured by any suitable means.

One simple means by which the level of deposits in a part of a post combustion system may be determined is by weighing the part of the system before and after use. One or more parts of the system may be weighed.

Other less direct methods may also be used. For example an improvement in fuel economy may indicate longer regeneration intervals on a diesel particulate filter.

Preferably the present invention provides an improvement in fuel economy of at least 0.1%, preferably at least 0.5%, suitably at least 1%, for example at least 2%.

The engine management system of a vehicle may be interrogated to assess the performance of components such as the turbocharger, the diesel particulate filter, the diesel oxidation catalyst and the selective catalytic reduction unit.

The invention may result in fewer error messages being provided by the engine management system to a driver.

An increase in the necessary maintenance intervals for a catalytic components may also indicate improved performance due to deposit reduction.

The deposits that form in the post combustion system may be analysed. This may be achieved, for example by extracting the deposits or a portion thereof into a solvent. The sample may be separated into soluble and non soluble fractions; these may then be separately analysed by methods known to those skilled in the art, for example elemental analysis, thermogravimetric analysis and/or gas chromatography mass spectrometry.

Thermogravimetric analysis (or TGA) involves measuring the mass of a sample over time as it is heated. This technique is well known to the person skilled in the art and the selection of an appropriate method and suitable equipment will be within the competence of one skilled in the art.

When post composition deposits contain soot, the soot density can be measured, for example using an AVL483 microsoot sensor.

Particle size of the soot can be measured by techniques known to these skilled in the art.

The reduction of deposits in the post combustion system of a diesel engine according to the present invention offers significant benefits.

These include, but are not limited to: an increase in power generation; an increase in torque; an increase in fuel economy; a reduction in emissions; a reduction in combustion chamber deposits; an acceleration improvement; driveability improvements; a reduction in cold start issues; lower soot formation; mitigation of lubricant degradation and/or performance loss; a reduction in diesel exhaust fluid and consumption e.g. urea consumption; reduction in wear on all post combustion components (including but not limited to the turbo charger, oxidation catalyst, DPF, SCR CAT, sensors, and injectors within the post combustion system); increased longevity of exhaust components; an increase in the maintenance period for the engine and/or post combustion components; and the protection of intake components downstream of the EGR, for example swirl flaps, throttles and the intake manifold (due to a reduction in the likelihood of blocking etc.).

In some embodiments of the present invention one or more of (a) a quaternary ammonium salt additive; (b) the reaction product of a carboxylic acid-derived acylating agent and an amine; and (c) the product of a Mannich reaction between an aldehyde, an amine and an optionally substituted phenol reduces the formation of deposits in an EGR system, preferably by at least 5%, for example by at least 20% or at least 50%.

In some embodiments of the present invention one or more of (a) a quaternary ammonium salt additive; (b) the reaction product of a carboxylic acid-derived acylating agent and an amine; and (c) the product of a Mannich reaction between an aldehyde, an amine and an optionally substituted phenol reduces the impact of deposits on one or more of a turbocharger, a diesel oxidation catalyst, a diesel particulate filter, a selective catalytic reduction unit and an ammonia oxidation catalyst.

In some embodiments of the present invention one or more of (a) a quaternary ammonium salt additive; (b) the reaction product of a carboxylic acid-derived acylating agent and an amine; and (c) the product of a Mannich reaction between an aldehyde, an amine and an optionally substituted phenol prevents and/or removes deposits on sensors within the post combustion system, for example deposits on NOx sensors, temperature sensors and/or pressure sensors.

In some embodiments of the present invention the combination of (a) a quaternary ammonium salt additive; (b) the reaction product of a carboxylic acid-derived acylating agent and an amine; and (c) the product of a Mannich reaction between an aldehyde, an amine and an optionally substituted phenol reduces the formation of deposits in an EGR system, preferably by at least 5%, for example by at least 20% or at least 50%.

In some embodiments of the present invention the combination of (a) a quaternary ammonium salt additive; (b) the reaction product of a carboxylic acid-derived acylating agent and an amine; and (c) the product of a Mannich reaction between an aldehyde, an amine and an optionally substituted phenol reduces the impact of deposits on one or more of a turbocharger, a diesel oxidation catalyst, a diesel particulate filter, a selective catalytic reduction unit and an ammonia oxidation catalyst.

In some embodiments of the present invention the combination of (a) a quaternary ammonium salt additive; (b) the reaction product of a carboxylic acid-derived acylating agent and an amine; and (c) the product of a Mannich reaction between an aldehyde, an amine and an optionally substituted phenol prevents and/or removes deposits on sensors within the post combustion system, for example deposits on NOx sensors, temperature sensors and/or pressure sensors.

In some embodiments of the present invention the combination of (a) a quaternary ammonium salt additive; (b); and the reaction product of a carboxylic acid-derived acylating agent and an amine (c) the product of a Mannich reaction between an aldehyde, an amine and an optionally substituted phenol reduces the formation of deposits on a diesel particulate filter, suitably by at least 0.01%, preferably by at least 2%.

In some embodiments of the present invention the combination of (a) a quaternary ammonium salt additive; (b) the reaction product of a carboxylic acid-derived acylating agent and an amine; and (c) the product of a Mannich reaction between an aldehyde, an amine and an optionally substituted phenol increases the interval between regenerations of a diesel particulate filter.

In some embodiments of the present invention the combination of (a) a quaternary ammonium salt additive; and (b) the reaction product of a carboxylic acid-derived acylating agent and an amine; reduces the impact of deposits on one or more of a turbocharger, a diesel oxidation catalyst, a diesel particulate filter, a selective catalytic reduction unit and an ammonia oxidation catalyst; wherein component (a) comprises a quaternary ammonium salt formed by reacting methyl salicylate, dimethyl oxalate or propylene oxide (optionally in combination with an acid) with the reaction product of a polyisobutylene-substituted succinic anhydride having a PIB molecular weight (Mn) of 700 to 1300 and dimethylaminopropylamine; component (b) comprises the reaction product of a polyisobutene-substituted succinic acid or succinic anhydride and a polyethylene polyamine selected from ethylenediamine, diethylenetriamine, triethylenetetramine, tetraethylenepentamine, pentaethylenehexamine, hexaethylene-heptamine and mixtures and isomers thereof; wherein polyisobutene substituent has a number average molecular weight of between 500 and 2000, preferably between 600 and 1200.

Any feature of the invention may be combined with any other feature as appropriate.

In some preferred embodiments of the use of the first aspect or the method of the second aspect for reducing the impact of deposits in a post combustion system of a diesel engine when combusting a diesel fuel composition, the nitrogen containing detergent is (a) a quaternary ammonium salt additive formed by the reaction of a quaternising agent and a compound including a tertiary amine group; wherein the compound including a tertiary amine group is (i-b) the reaction product of a hydrocarbyl substituted succinic acid derived acylating agent and a compound of formula (II), wherein both $R^2$ and $R^3$ are $C_1$ to $C_4$ alkyl groups and X is alkylene group having from 2 to 5 carbon atoms.

In such embodiments the compound of formula (II) is preferably selected from N,N-dimethyl-1,3-diaminopropane, N,N-diethyl-1,3-diaminopropane, N,N-dimethylethylenediamine, N,N-diethylethylenediamine, N,N-dibutylethylenediamine, or combinations thereof.

In some preferred embodiments of the use of the first aspect or the method of the second aspect for reducing the impact of deposits in a post combustion system of a diesel engine when combusting a diesel fuel composition, the nitrogen containing detergent is (a) a quaternary ammonium salt additive formed by the reaction of a quaternising agent and a compound including a tertiary amine group; wherein the compound including a tertiary amine group is (iv-a) a tertiary amine of formula $R^5R^6R^7N$, wherein each of $R^5$, $R^6$ and $R^7$ is independently an alkyl group or a hydroxyalkyl group.

In such embodiments, preferably each of $R^5$ and $R^6$ is $C_1$ to $C_4$ alkyl, preferably methyl, and $R^7$ is an alkyl or alkenyl group having 12 to 24 carbon atoms.

In some preferred embodiments of the use of the first aspect or the method of the second aspect for reducing the impact of deposits in a post combustion system of a diesel engine when combusting a diesel fuel composition, the nitrogen containing detergent is (a) a quaternary ammonium salt additive formed by the reaction of a quaternising agent and a reaction product of a hydrocarbyl substituted succinic acid derived acylating agent and a compound of formula (II), wherein both $R^2$ and $R^3$ are $C_1$ to $C_4$ alkyl groups and X is alkylene group having from 2 to 5 carbon atoms which is predominantly in the succinamide form (i.e. half-acid half-amide compounds).

In such embodiments, the hydrocarbyl substituted succinic acid derived acylating agent is preferably a polyisobutylene-substituted succinic anhydride having a PIB molecular weight (Mn) of 700 to 1300 and the compound of formula (II) is preferably selected from N,N-dimethyl-1,3-diaminopropane, N,N-diethyl-1,3-diaminopropane, N,N-dimethylethylenediamine, N,N-diethylethylenediamine, N,N-dibutylethylenediamine, or combinations thereof; preferably dimethylaminopropylamine.

In some preferred embodiments of the use of the first aspect or the method of the second aspect, the nitrogen containing detergent is selected from one or more of (a) a quaternary ammonium salt additive; (b) the reaction product of a carboxylic acid-derived acylating agent and an amine; and (c) the product of a Mannich reaction between an aldehyde, an amine and an optionally substituted phenol; and the use or method reduces the formation of deposits on the turbocharger of the post combustion system.

In such embodiments, the nitrogen containing detergent is preferably selected from one or more of:

(a) a quaternary ammonium salt additive which is the reaction product of a compound including a tertiary amine group and a quaternising agent, wherein the quaternising agent is preferably selected from alkylene oxide (preferably propylene oxide), optionally in combination with an acid, chloroacetic acid or a salt thereof, methyl salicylate or dimethyl oxalate; and wherein the compound including a tertiary amine group is selected from:
  - (i-a) the reaction product of a fatty acid of formula RCOOH in which R is an alkyl or alkenyl group having 12 to 24 carbon atoms, and a compound of formula (II), wherein both $R^2$ and $R^3$ are $C_1$ to $C_4$ alkyl groups and X is alkylene group having from 2 to 5 carbon atoms;
  - (i-b) the reaction product of a hydrocarbyl substituted succinic acid derived acylating agent and a compound of formula (II), wherein both $R^2$ and $R^3$ are $C_1$ to $C_4$ alkyl groups and X is alkylene group having from 2 to 5 carbon atoms; and
  - (iv-a) a tertiary amine of formula $R^5R^6R^7N$, wherein each of $R^5$, $R^6$ and $R^7$ is independently an alkyl group or a hydroxyalkyl group;

(b) the reaction product of a polyisobutene-substituted succinic acid or succinic anhydride and a polyethylene polyamine selected from ethylenediamine, diethylenetriamine, triethylenetetramine, tetraethylenepentamine, pentaethylenehexamine, hexaethylene-heptamine and mixtures and isomers thereof; wherein polyisobutene substituent has a number average molecular weight of between 500 and 2000, preferably between 600 and 1200; and (c) the reaction product of formaldehyde, a polyethylene polyamine and a para-substituted monoalkyl phenol, preferably dodecyl phenol.

In such embodiments, the nitrogen containing detergent is preferably selected from:

(a) a quaternary ammonium salt additive which is the reaction product of a compound including a tertiary amine group and a quaternising agent, wherein the quaternising agent is preferably selected from alkylene oxide (preferably propylene oxide), optionally in combination with an acid, chloroacetic acid or a salt thereof, methyl salicylate or dimethyl oxalate; and wherein the compound including a tertiary amine group is selected from:
  - (i-a) the reaction product of a fatty acid of formula RCOOH in which R is an alkyl or alkenyl group having 12 to 24 carbon atoms, and a compound of formula (II), wherein both $R^2$ and $R^3$ are $C_1$ to $C_4$ alkyl groups and X is alkylene group having from 2 to 5 carbon atoms;
  - (i-b) the reaction product of a hydrocarbyl substituted succinic acid derived acylating agent and a compound of formula (II), wherein both $R^2$ and $R^3$ are $C_1$ to $C_4$ alkyl groups and X is alkylene group having from 2 to 5 carbon atoms;

and (b) the reaction product of a polyisobutene-substituted succinic acid or succinic anhydride and a polyethylene polyamine selected from ethylenediamine, diethylenetriamine, triethylenetetramine, tetraethylenepentamine, pentaethylenehexamine, hexaethylene-heptamine and mixtures and isomers thereof; wherein polyisobutene substituent has a number average molecular weight of between 500 and 2000, preferably between 600 and 1200.

In such embodiments, the nitrogen containing detergent is preferably (a) a quaternary ammonium salt additive which is the reaction product of a compound including a tertiary amine group and a quaternising agent, wherein the quaternising agent is preferably selected from alkylene oxide (preferably propylene oxide), optionally in combination with an acid, chloroacetic acid or a salt thereof, methyl salicylate or dimethyl oxalate; and wherein the compound including a tertiary amine group is selected from:

(i-a) the reaction product of a fatty acid of formula RCOOH in which R is an alkyl or alkenyl group having 12 to 24 carbon atoms, and a compound of formula (II), wherein both $R^2$ and $R^3$ are $C_1$ to $C_4$ alkyl groups and X is alkylene group having from 2 to 5 carbon atoms;

(i-b) the reaction product of a hydrocarbyl substituted succinic acid derived acylating agent and a compound of formula (II), wherein both $R^2$ and $R^3$ are $C_1$ to $C_4$ alkyl groups and X is alkylene group having from 2 to 5 carbon atoms.

In such embodiments, the nitrogen containing detergent is preferably (b) the reaction product of a polyisobutene-substituted succinic acid or succinic anhydride and a polyethylene polyamine selected from ethylenediamine, diethylenetriamine, triethylenetetramine, tetraethylenepentamine, pentaethylenehexamine, hexaethylene-heptamine and mixtures and isomers thereof; wherein polyisobutene substituent has a number average molecular weight of between 500 and 2000, preferably between 600 and 1200.

In such embodiments, the nitrogen containing detergent is preferably (c) the product of a Mannich reaction between an aldehyde, an amine and an optionally substituted phenol.

In some preferred embodiments of the use of the first aspect or the method of the second aspect, the nitrogen containing detergent is selected from one or more of (a) a quaternary ammonium salt additive; (b) the reaction product of a carboxylic acid-derived acylating agent and an amine; and (c) the product of a Mannich reaction between an aldehyde, an amine and an optionally substituted phenol; and the use or method reduces the formation of deposits in the diesel particulate filter of the post combustion system. Suitably the use or method reduces the accumulation of soot in the diesel particulate filter.

In such embodiments, the nitrogen containing detergent is preferably selected from one or more of:

(a) a quaternary ammonium salt additive which is the reaction product of a compound including a tertiary amine group and a quaternising agent, wherein the quaternising agent is preferably selected from alkylene oxide (preferably propylene oxide), optionally in combination with an acid, chloroacetic acid or a salt thereof, methyl salicylate or dimethyl oxalate; and wherein the compound including a tertiary amine group is selected from:

(i-a) the reaction product of a fatty acid of formula RCOOH in which R is an alkyl or alkenyl group having 12 to 24 carbon atoms, and a compound of formula (II), wherein both $R^2$ and $R^3$ are $C_1$ to $C_4$ alkyl groups and X is alkylene group having from 2 to 5 carbon atoms;

(i-b) the reaction product of a hydrocarbyl substituted succinic acid derived acylating agent and a compound of formula (II), wherein both $R^2$ and $R^3$ are $C_1$ to $C_4$ alkyl groups and X is alkylene group having from 2 to 5 carbon atoms; and (iv-a) a tertiary amine of formula $R^5R^6R^7N$, wherein each of $R^5$, $R^6$ and $R^7$ is independently an alkyl group or a hydroxyalkyl group;

(b) the reaction product of a polyisobutene-substituted succinic acid or succinic anhydride and a polyethylene polyamine selected from ethylenediamine, diethylenetriamine, triethylenetetramine, tetraethylenepentamine, pentaethylenehexamine, hexaethylene-heptamine and mixtures and isomers thereof; wherein polyisobutene substituent has a number average molecular weight of between 500 and 2000, preferably between 600 and 1200; and (c) the reaction product of formaldehyde, a polyethylene polyamine and a para-substituted monoalkyl phenol, preferably dodecyl phenol.

In such embodiments, the nitrogen containing detergent is preferably selected from:

(a) a quaternary ammonium salt additive which is the reaction product of a compound including a tertiary amine group and a quaternising agent, wherein the quaternising agent is preferably selected from alkylene oxide (preferably propylene oxide), optionally in combination with an acid, chloroacetic acid or a salt thereof, methyl salicylate or dimethyl oxalate; and wherein the compound including a tertiary amine group is selected from:

(i-a) the reaction product of a fatty acid of formula RCOOH in which R is an alkyl or alkenyl group having 12 to 24 carbon atoms, and a compound of formula (II), wherein both $R^2$ and $R^3$ are $C_1$ to $C_4$ alkyl groups and X is alkylene group having from 2 to 5 carbon atoms;

(i-b) the reaction product of a hydrocarbyl substituted succinic acid derived acylating agent and a compound of formula (II), wherein both $R^2$ and $R^3$ are $C_1$ to $C_4$ alkyl groups and X is alkylene group having from 2 to 5 carbon atoms;

and (b) the reaction product of a polyisobutene-substituted succinic acid or succinic anhydride and a polyethylene polyamine selected from ethylenediamine, diethylenetriamine, triethylenetetramine, tetraethylenepentamine, pentaethylenehexamine, hexaethylene-heptamine and mixtures and isomers thereof; wherein polyisobutene substituent has a number average molecular weight of between 500 and 2000, preferably between 600 and 1200.

In such embodiments, the nitrogen containing detergent is preferably (a) a quaternary ammonium salt additive which is the reaction product of a compound including a tertiary amine group and a quaternising agent, wherein the quaternising agent is preferably selected from alkylene oxide (preferably propylene oxide), optionally in combination with an acid, chloroacetic acid or a salt thereof, methyl salicylate or dimethyl oxalate; and wherein the compound including a tertiary amine group is selected from:

(i-a) the reaction product of a fatty acid of formula RCOOH in which R is an alkyl or alkenyl group having 12 to 24 carbon atoms, and a compound of formula (II), wherein both $R^2$ and $R^3$ are $C_1$ to $C_4$ alkyl groups and X is alkylene group having from 2 to 5 carbon atoms;

(i-b) the reaction product of a hydrocarbyl substituted succinic acid derived acylating agent and a compound of formula (II), wherein both $R^2$ and $R^3$ are $C_1$ to $C_4$ alkyl groups and X is alkylene group having from 2 to 5 carbon atoms.

In such embodiments, the nitrogen containing detergent is preferably (b) the reaction product of a polyisobutene-substituted succinic acid or succinic anhydride and a polyethylene polyamine selected from ethylenediamine, diethylenetriamine, triethylenetetramine, tetraethylenepentamine, pentaethylenehexamine, hexaethylene-heptamine and mixtures and isomers thereof; wherein polyisobutene substituent has a number average molecular weight of between 500 and 2000, preferably between 600 and 1200.

In such embodiments, the nitrogen containing detergent is preferably (c) the product of a Mannich reaction between an aldehyde, an amine and an optionally substituted phenol.

The invention will now be further described with reference to the following non-limiting examples. In the examples which follow the values given in parts per million (ppm) for treat rates denote active agent amount, not the amount of a formulation as added, and containing an active agent. All parts per million are by weight.

Example 1

Additive A, a Mannich reaction product, was prepared as follows:

To a 1 L jacketed glass reactor, was transferred 4-dodecylphenol (129.6 g, 0.494 moles, 1.7 equivalents). Aromatic A150 solvent (95.2 g) was added and heated to 75° C. Ethylenediamine (17.5 g, 0.291 moles, 1 eq) was added and the mixture was heated to 90° C. 37% aq formalin (94.3 g, 1.16 moles, 4 equivs) was then added, keeping the reaction mixture temperature in the range 90-96° C. The reactor was sealed, and the temperature increased to 120° C. over 3 hrs. This was accompanied by a pressure increase to 0.8 barg. The reaction mixture was held for 3 hrs at 120-122° C., at pressure up to 1.1 barg. The reaction temperature was then decreased to −95° C. and the pressure dropped to <0.5 bar, at which point the reactor was opened to the atmosphere. Agitation was stopped and the contents allowed to separate. The amber organic phase was washed twice with water at 90-90° C. Finally, any residual water was removed from the organic phase under reduced pressure, leaving a clear and bright amber liquid, additive A (235 g).

Example 2

Additive B, a quaternary ammonium salt additive, was prepared as follows:

HR 1000 MW polyisobuylene (126.37 g, 126 mmol, 1.0 eqs) was heated to 190° C. then maleic anhydride (12.47 g, 127 mmol, 1.0 eqs) added over 1 hour. The reaction was heated to 205° C. then held for eight hours. Unreacted maleic anhydride was removed by vacuum distillation. The resulting PIBSA was cooled to 120° C. and DMAPA (11.9 g, 116 mmol, 0.9 eq) charged keeping the reaction temperature in the range 120° C.-130° C. The reaction was stirred then the temperature increased to 140° C. to allow distillation of water. Once distillation was complete, methyl salicylate (17.36 g, 114 mmol, 0.9 eqs) was charged and the reaction heated at 140° C. until the reaction was complete. The reaction is diluted with solvent then cooled and discharged to provide the product, additive B (271.2 g).

Example 3

Additive C, a polyisobutenyl substituted succinimide additive, was prepared as follows:

Using the reaction set up of a 1 L jacketed glass reactor, fitted with a Dean Stark condenser, overhead stirrer, dropping funnel and nitrogen input. To the reactor was transferred 600 g of PIBSA (HR 750 MW PIB, 0.768 moles) and 483.33 g of Aromatic A150 solvent. The mixture was stirred and heated to 65° C. to form a homogenous liquid. Then tetraethylenepentamine (138.12 g, 0.729 mol) was charged to the reactor over 1 hour via the dropping funnel. The temperature of the mixture was increased to 135° C. and held for 1 hour allowing distillation of water. The temperature of the mixture was then increased to 165° C. and held for 3 hours. After distillation was complete the product, additive C, was cooled and transferred to storage (1208.32 g).

Example 4

Additives A, B and C were dosed in the amounts specified in Table 1 into a diesel fuel composition comprising 7 vol % RME in a mineral diesel fuel. The specification of the mineral diesel fuel is set out in Table 2.

TABLE 1

| Additive | ppm active |
|---|---|
| A | 36.4 |
| B | 33.6 |
| C | 120 |

TABLE 2

| Property | Units | Limits Min | Max | Method |
|---|---|---|---|---|
| Cetane Number | | 52.0 | 54.0 | EN ISO 5165 |
| Density at 15° C. | kg/m$^3$ | 833 | 837 | EN ISO 3675 |
| Distillation | | | | |
| 50% v/v Point | ° C. | 245 | — | |
| 95% v/v Point | ° C. | 345 | 350 | |
| FBP | ° C. | — | 370 | |
| Flash Point | ° C. | 55 | — | EN 22719 |
| Cold Filter Plugging Point | ° C. | — | −5 | EN 116 |
| Viscosity at 40°C | mm$^2$/sec | 2.3 | 3.3 | EN ISO 3104 |
| Polycyclic Aromatic Hydrocarbons | % m/m | 3.0 | 6.0 | IP 391 |
| Sulphur Content | mg/kg | — | 10 | ASTM D 5453 |
| Copper Corrosion | | — | 1 | EN ISO 2160 |
| Conradson Carbon Residue on 10% Dist. Residue | % m/m | — | 0.2 | EN ISO 10370 |
| Ash Content | % m/m | — | 0.01 | EN ISO 6245 |
| Water Content | % m/m | — | 0.02 | EN ISO 12937 |
| Neutralisation (Strong Acid) Number | mg KOH/g | — | 0.02 | ASTM D 974 |
| Oxidation Stability | mg/mL | — | 0.025 | EN ISO 12205 |
| HERR (WSD1,4) | µm | — | 400 | CEC F-06-A-96 |
| Fatty Acid Methyl Ester | | prohibited | | |

Example 5

The ability of the diesel fuel composition of example 3 to reduce the formation of deposits in the diesel particulate filter was assessed according to the following procedure:

A Mercedes Sprinter 314CDI equipped with a 2.1 litre direct-injection OM651 DE 22 LA engine was taken from the marketplace and installed on a state-of-the-art four-wheel chassis hub dynamometer. For the purposes of testing, the vehicle's fuel tank was bypassed by a test cell fuel supply. This ensured minimal carry over between the test fuels and accurate consumption measurement.

Following initial setup, two baseline runs were completed using additive-free EN590 compliant diesel with a 7% v/v RME content. The rate of DPF saturation was monitored via the vehicles CAN network from an immediately post-regeneration state to reported 100% load. The data was aligned to ~10% loading for comparison. The time to reach 100% load was consistent, averaging 2.76 hours.

The baseline fuel was dosed with additives in the amounts specified in table 1 and the DPF loading cycle repeated a further four times.

Once the Sprinter had switched to the additised fuel, an immediate 13% increase in time to regeneration versus the baseline average was observed.

Subsequent test runs conducted using the additised fuel consistently demonstrated improved performance compared with the previous. The fourth and final treated test run extended the time to regeneration to 4.90 hours, equivalent to a 77% increase.

These results are shown in FIG. 1.

Example 6

Additive D, a quaternary ammonium salt additive, was prepared as follows:

700 g (0.7 mol) of polyisobutylene (Mn 1000) was charged to a nitrogen flushed, jacketed reactor fitted with an overhead stirrer. The starting material was heated to 120° C. with stirring and nitrogen inerting was repeated. The reaction temperature was increased to 190° C. and maleic anhydride (82.4 g, 0.84 mol, 1.2 eq) was charged over 1 hour. After maintaining a temperature of 190° C. for a further 1 hour, the temperature was increased to 200-208° C. and held in this range for 8 hours. Vacuum (<30 mbar) was then applied for 2.5 hrs, whilst maintaining the reaction temperature, which reduced the level of residual maleic anhydride to ≤0.05 wt %. The reaction mass was cooled to ≤80° C. then discharged from the reactor.

PIBSA prepared as described above was charged to a nitrogen flushed, jacketed reactor fitted with an overhead stirrer and heated to 120° C. 3-(dimethylamino)propylamine (DMAPA) (1 eq relative to anhydride groups) was charged slowly, maintaining the reaction temperature between 120-130° C. After stirring at 120° C. for a further 1 hr, the reaction temperature was increased to 140° C. and held for 3 hrs with concurrent distillation of water. Methyl salicylate (2.1 eq relative to anhydride groups) was added in a single portion and heating was continued at 140° C. for 10 hours. The reaction mass was diluted with Aromatic 150 solvent to provide an overall solids content of 60 wt % prior to discharging from the reactor to provide additive D.

Example 7

Additive E, an oleyl amido propyl betaine additive, was prepared as follows:

A Lenz jacketed reactor was charged with 183.5 g (0.5 moles) oleyl amidopropyl dimethylamine (N-[3-(Dimethylamino)propyl]oleamide), 68 ml isopropylalcohol, 25.5 g (1.42 moles) water and 56.5 g (0.48 moles) sodium chloroacetate. The reaction mixture was heated to 80° C. and then heated for approx. 6 hrs at 80-85° C., before being cooled and allowed to stand under $N_2$ overnight. Following this the reaction mixture was re-heated to 60° C. and charged with 300 ml of isopropylalcohol (IPA) and 67.5 g of 2-ethylhexanol. Then the heat was increased further to 90° C. This afforded the azeotropic removal of $H_2O$ and IPA and precipitation of NaCl. A 100 mbar vacuum was applied to remove the remaining water and some solvent and the resulting suspension was filtered at 75-80° C. through a glass microfibre filter. 275.6 g of additive E was collected, which contained 53 wt % actives.

Example 8

Additive F, a quaternary ammonium salt of a polyisobutenyl substituted succinic half-acid half-amide, was prepared as follows:

A Lenz jacketed reactor equipped with a $N_2$ inlet, and reflux condenser was charged with 123.2 g (0.105 moles, 1.0 eq) of a polyisobutenyl substituted succinic anhydride (1000 MW PIB) and 123.0 g A150 solvent. 8.9 g (0.087 moles, 0.83 equivs) N,N-dimethylaminopropylamine (DMAPA) was added via a dropping funnel over approx. 30 mins. During the addition the reaction is kept at 20° C.-25° C. and following the addition the mixture was allowed to stir for 1 hr. The reaction mixture temperature had subsided to 17° C. and propylene oxide (12.2 g) was added over approx. 25 mins. Following the addition, the temperature was maintained at 20-22° C. whilst stirring. This was maintained for 4 hrs. The reactor was opened and left stirring for 2 hrs to let excess propylene oxide gas off. 264.4 g of a deep orange liquid of additive F was collected. The active content was 50 wt %.

Example 9

Additive G, a polyisobutenyl substituted succinic acid quaternary ammonium salt of hexadecyldimethyl amine, was prepared as follows:

A 1 L pressure reactor was charged with 251.1 g (0.20 moles) of Polyisobutenyl substituted succinic acid (1000 MW PIB) which was pre-warmed as it is a viscous liquid. Then 207 g of 2-ethylhexanol was added. 48.7 g (0.181 moles) of N,N-dimethylhexadecylamine was then added with stirring at 30° C. 21.0 g (0.362 moles, 2 eq) of propylene oxide was added and the reactor was sealed. Using nitrogen, the pressure in the reactor was increased to 2.0 bar, and the temperature was increased to 43-48° C. This was maintained overnight for a total of 17 hrs at which point the pressure in the reactor had decreased to 1.2 bar at a temperature of 43° C. When the pressure in the reactor decreased further to 1.0 bar, the reactor was unsealed and pressure released. Excess PO was allowed to gas off. This provided 610.5 g of clear orange liquid of additive G. A conversion of 93.4% was determined analytically. The active content was 60 wt %.

Example 10

Additives A, D and C were dosed in the amounts specified in Table 3 into the diesel fuel composition described below in relation to Example 11.

TABLE 3

| Additive | ppm active |
|---|---|
| A | 36.4 |
| D | 33.6 |
| C | 120 |

Example 11—Engine Testing

Engine testing was carried out as described below to assess the performance of the nitrogen-containing additives of the present invention in the reduction of deposits in the post combustion system of diesel engines.

Engine Details

A Euro 6 compliant 2.0 litre, HSDI engine was connected to a test automation system and test bed fitted with an engine dynamometer. The engine was controlled by an ECU supplied by the engine manufacturer. The engine had had over 1100 h of use prior to the first test. The engine oil was changed prior to performing the first test.

Modifications/Test Setup

1. No SCR Catalyst or associated components were present in the exhaust system.
2. High pressure EGR cooler is artificially controlled to 40° C. for the duration of the test.

The base fuel was an RF-06-03 diesel fuel (Haltermann Carless, UK) having the following specification:

| Feature | Units | Results | Minimum | Maximum | Method |
|---|---|---|---|---|---|
| Density 15° C. | kg/m$^3$ | 836.0 | 833.0 | 837.0 | ASTM D4052 |
| Marker (Red) | — | Pass | — | — | VISUAL |
| Cetane Number | | 53.9 | 52.0 | 54.0 | ASTM D613 |
| I. B. Pt. | ° C. | 214.3 | | | ASTM D86 |
| 10% v/v Recovered at | ° C. | 232.0 | | | ASTM D86 |
| 50% v/v Recovered at | ° C. | 275.5 | 245.0 | — | ASTM D86 |
| 90% v/v Recovered at | ° C. | 330.2 | | | ASTM D86 |
| 95% v/v Recovered at | ° C. | 348.0 | 345.0 | 350.0 | ASTM D86 |
| F. B. Pt. | ° C. | 356.2 | — | 370.0 | ASTM D86 |
| Aromatics by FIA | %(V/V) | 19.8 | Corrected for | | ASTM D1319 |
| Olefins by FIA | %(V/V) | 5.5 | | | |
| Flash Point, Pensky Closed | ° C. | 92.0 | 55.0 | — | ASTM D93 |
| Sulphur Content | mg/kg | <3.0 | — | 10.0 | ASTM D5453 |
| Viscosity at 40° C. | mm2/s | 3.062 | 2.300 | 3.300 | ASTM D445 |
| Cloud Point | ° C. | −18 | | | ASTM D2500 |
| CFPP | ° C. | −20 | — | −15 | EN 116 |
| Lubricity (WSD 1,4) at 60° C. | μm | 180 | — | 400 | ISO 12156-1 |
| Carbon Residue (on 10% Dist. Res) | %(m/m) | <0.10 | — | 0.20 | ASTM D4530 |
| Ash | %(m/m) | <0.001 | — | 0.010 | ASTM D482 |
| FAME Content: None Detected | — | Pass | — | — | EN 14078 |
| Polycyclic Aromatic Hydrocarbons | %(m/m) | 5.8 | 3.0 | 6.0 | EN 12916 |
| Total Aromatic Hydrocarbons | %(m/m) | 22.2 | | | EN 12916 |
| Water Content | mg/kg | 50 | — | 200 | IP 438 |
| Water & Sediment | %(V/V) | <0.010 | | | ASTM D2709 |
| Strong Acid Number | mg | 0 KOH/g | — | 0.02 | ASTM D974 |
| Oxidation Stability | mg | <0.1 per 100 ml | — | 2.5 | ASTM D2274 |
| Copper Corrosion, 3 hrs at 100° C. | — | 1B | — | — | ASTM D130 |
| Oxygen Content | %(m/m) | <0.04 | ELEMENTAL | | Elemental Analysis |
| Carbon Content | %(m/m) | 86.89 | ASTM D5291 | | ASTM D5291 |
| Hydrogen Content | %(m/m) | 13.11 | ASTM D5291 | | ASTM D5291 |
| Carbon Weight Fraction | | 0.8689 | CALCULATION | | Calculation |
| C/H Mass Ratio | | 6.63 | CALCULATION | | Calculation |
| Atomic H/C Ratio | | 1.7979 | CALCULATION | | Calculation |
| Atomic O/C Ratio | | <0.0003 | CALCULATION | | Calculation |
| Gross Heat of Combustion | MJ/kg | 45.72 | IP 12 | | IP 12 |
| Net Heat of Combustion | MJ/kg | 42.94 | IP 12 | | IP 12 |
| Net Heat of Combustion | btu/lb | 18460 | CALCULATION | | Calculation |

Test Additives, Treat Rate:

The example nitrogen-containing detergents were dosed at 100 mg/kg into the base diesel fuel described above. The nitrogen-containing detergent A was dosed into the base fuel to provide test fuel 1, the nitrogen-containing detergent C was dosed into the base fuel to provide test fuel 2 and the nitrogen-containing detergent mixture described in Example 10 provided test fuel 3.

Method of Soot Deposition Measurement (DPF & EGR Soot Weight)

The quantity of soot deposited in the DPF was established by weighing both components before and after each test.

Prior to the initial weighing, the DPF is passively regenerated on the test bed to remove any residual soot. Once the regeneration is complete, the DPF is placed into an oven, pre-heated to 185° C., affixed to a set of scales. The weight measurement was taken as an average over 15 minutes, once the scales had stabilised. This weighing process is repeated at the end of the test. The variance between the weight measured before and after the test represents the change in mass due to soot deposition.

Test Procedure

[D] EGR Cleaned and weighed
[D] DPF+Slave EGR Installation
Engine Start+Warm-Up
Passive DPF Regeneration by varying the engine speed and load until the regeneration is complete. The differential pressure across the is used to monitor the regeneration progress.
Engine Stop
Change to test fuel
[C] DPF+Slave EGR Removal
[C] DPF Start-of-Test (SOT) Weighing
[C] DPF+[C] EGR Installation Engine Start+Warm-Up
8-Hour Steady-State Test Cycle
1200 RPM
60 Nm
Engine Stop
[D] DPF Removal and End-of-Test (EOT) Weighing
[D] EGR Removal and EGR End of Test Weighing
[C] indicates a clean component
[D] indicates a fouled component Results

| Test fuel | Additive | Treat rate (mg/kg) | DPF Soot Weight [g] |
|---|---|---|---|
| Base fuel | — | — | 36.35 |
| 1 | A | 100 | 19.51 |
| 2 | C | 100 | 36.05 |
| 3 | A, D, C | 36.4, 33.6, 120 | 26.99 |

These results demonstrate that the use of the nitrogen-containing detergents described herein as additives in a diesel fuel composition may provide a significant reduction in deposits in the post combustion system of a diesel engine combusting said fuel, specifically a reduction in the soot deposited on the diesel particulate filter of the post combustion system.

The invention claimed is:

1. A method of reducing the impact of deposits in a post combustion system of a diesel engine, the method comprising combusting in the engine a diesel fuel composition comprising as an additive one or more nitrogen containing detergent, wherein the method reduces the formation of deposits in the post combustion system of a diesel engine; and wherein the one or more nitrogen containing detergents are selected from:

(a) quaternary ammonium salt additives;

(b) the reaction product of a carboxylic acid-derived acylating agent and an amine;

(c) the product of a Mannich reaction between an aldehyde, an amine and an optionally substituted phenol; and (d) mixtures thereof.

2. The method of claim 1, wherein the diesel fuel composition comprises (a) a quaternary ammonium salt additive.

3. The method of claim 1, wherein the diesel fuel composition comprises (b) the reaction product of a hydrocarbyl substituted acylated agent and an amine.

4. The method of claim 1, wherein the diesel fuel composition comprises (c) the product of a Mannich reaction between an aldehyde, an amine and an optionally substituted phenol.

5. The method of claim 1, wherein component (a) comprises a quaternary ammonium salt formed by reacting methyl salicylate, dimethyl oxalate or propylene oxide (optionally in combination with an acid) with the reaction product of a polyisobutylene-substituted succinic anhydride having a PIB molecular weight (Mn) of 700 to 1300 and dimethylaminopropylamine.

6. The method of claim 1, wherein component (a) comprises a quaternary ammonium salt formed by reacting methyl salicylate, dimethyl oxalate or propylene oxide (optionally in combination with an acid) with the reaction product of a fatty acid of formula RCOOH in which R is an alkyl or alkenyl group having 12 to 24 carbon atoms, and a compound of formula (II), wherein both $R^2$ and $R^3$ are C1 to $C_4$ alkyl groups and X is alkylene group having from 2 to 5 carbon atoms.

7. The method of claim 1, wherein component (a) comprises a quaternary ammonium salt formed by reacting methyl salicylate, dimethyl oxalate or propylene oxide (optionally in combination with an acid) with a tertiary amine of formula $R^5R^6R^7N$, wherein each of $R^5$, $R^6$ and $R^7$ is independently an alkyl group or a hydroxy alkyl group.

8. The method of claim 1, wherein component (b) comprises the reaction product of a polyisobutene-substituted succinic acid or succinic anhydride and a polyethylene polyamine selected from ethylenediamine, diethylenetriamine, triethylenetetramine, tetraethylenepentamine, pentaethylenehexamine, hexaethylene-heptamine and mixtures and isomers thereof; wherein polyisobutene substituent has a number average molecular weight of between 500 and 2000.

9. The method of claim 1, wherein component (c) comprises the reaction product of formaldehyde, a polyethylene polyamine and a para-substituted monoalkyl phenol.

10. The method of claim 1, wherein the diesel fuel composition comprises from 1 to 1000 ppm of (a) a quaternary ammonium salt additive; and/or from 1 to 1000 ppm of (b) the reaction product of a carboxylic acid-derived acylating agent and an amine; and/or from 1 to 1000 ppm of (c) the product of a Mannich reaction between an aldehyde, an amine and an optionally substituted phenol.

11. The method of claim 1, further comprising reducing formation of deposits on the turbocharger of the post combustion system.

12. The method of claim 1, further comprising reducing formation of deposits on the diesel oxidation catalyst of the post combustion system.

13. The method of claim 1, further comprising reducing formation of deposits on the diesel particulate filter of the post combustion system.

14. The method of claim 1, further comprising reducing accumulation of soot in the diesel particulate filter.

15. The method of claim 1, further comprising reducing formation of deposits on the selective catalytic reduction unit of the post combustion system.

16. The method of claim 1, further comprising reducing formation of deposits on the ammonia oxidation catalyst of the post combustion system.

17. The method of claim 1, further comprising reducing formation of deposits on sensors within the post combustion system.

18. The method of claim 1, further comprising reducing formation of deposits the formation of deposits in one more components of the post combustion system by at least 5%.

19. The method of claim 1, wherein the diesel fuel composition comprises one or more nitrogen containing detergents.

20. The method of claim 1, wherein the diesel engine is an off road engine.

21. The method of claim 1, further comprising providing one or more benefits selected from: an increase in power generation; an increase in torque; an increase in fuel economy; a reduction in emissions; a reduction in combustion chamber deposits; an acceleration improvement; driveability improvements; a reduction in cold start issues; lower soot formation; mitigation of lubricant degradation and/or performance loss; a reduction in diesel exhaust fluid and consumption; reduction in wear on all post combustion components increased longevity of exhaust components; an increase in the maintenance period for the engine and/or post combustion components; and the protection of intake components downstream of the EGR.

22. The method of claim 1, wherein the one or more nitrogen containing detergent selected is from:

(a) a quaternary ammonium salt additive formed by reacting a quaternising agent with the reaction product of a hydrocarbyl substituted succinic acid derived acylating agent and a compound able to react with said acylating agent and which includes a tertiary amine group;

(b) the reaction product of a polyisobutene-substituted succinic acid-derived acylating agent and a polyethylene polyamine; or (c) the product of a Mannich reaction between formaldehyde, a polyethylene polyamine and a para-substituted monoalkyl phenol.

* * * * *